US009696098B2

(12) United States Patent
Magee et al.

(10) Patent No.: US 9,696,098 B2
(45) Date of Patent: Jul. 4, 2017

(54) METHOD AND APPARATUS FOR CONNECTING SECTIONS OF A ONCE-THROUGH HORIZONTAL EVAPORATOR

(71) Applicant: Alstom Technology Ltd., Braden (CH)

(72) Inventors: Jeffrey F. Magee, Longmeadow, MA (US); Wei D. Zhang, South Windsor, CT (US); Bruce W. Wilhelm, Enfield, CT (US); Vinh Q. Truong, Southington, CT (US); Christopher J. Lech, Feeding Hills, MA (US); James D. Pschirer, Enfield, CT (US)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 396 days.

(21) Appl. No.: 13/744,094

(22) Filed: Jan. 17, 2013

(65) Prior Publication Data

US 2013/0180696 A1 Jul. 18, 2013

Related U.S. Application Data

(60) Provisional application No. 61/587,332, filed on Jan. 17, 2012, provisional application No. 61/587,230,
(Continued)

(51) Int. Cl.
*F28F 9/26* (2006.01)
*F28F 9/02* (2006.01)
(Continued)

(52) U.S. Cl.
CPC ..... *F28F 9/02* (2013.01); *F16B 17/00* (2013.01); *F22B 29/06* (2013.01); *F28D 7/082* (2013.01);
(Continued)

(58) Field of Classification Search
CPC .... F28F 9/02; F28F 9/0131; F28F 9/26; F28F 1/00; F28F 9/02; F28D 7/082; F16B 17/00
(Continued)

(56) References Cited

U.S. PATENT DOCUMENTS 343,258 A 6/1886 Smith
459,998 A 9/1891 Davis
(Continued)

FOREIGN PATENT DOCUMENTS

CH 144501 A 12/1930
CN 2420739 Y 2/2001
(Continued)

OTHER PUBLICATIONS

First Office Action issued by the Chinese patent Office for Application No. 201380000530.X dated Sep. 6, 2015.
(Continued)

*Primary Examiner* — Davis Hwu
*Assistant Examiner* — Claire Rojohn, III
(74) *Attorney, Agent, or Firm* — GE Global Patent Operation; Stephen G. Midgley

(57) ABSTRACT

Disclosed herein is a once-through evaporator comprising an inlet manifold; one or more inlet headers in fluid communication with the inlet manifold; one or more tube stacks, where each tube stack comprises one or more substantially horizontal evaporator tubes; the one or more tube stacks being in fluid communication with the one or more inlet headers; one or more outlet headers in fluid communication with one or more tube stacks; and an outlet manifold in fluid communication with the one or more outlet headers.

20 Claims, 16 Drawing Sheets

Related U.S. Application Data filed on Jan. 17, 2012, provisional application No. 61/587,428, filed on Jan. 17, 2012, provisional application No. 61/587,359, filed on Jan. 17, 2012, provisional application No. 61/587,402, filed on Jan. 17, 2012.

(51) Int. Cl.

| | |
|---|---|
| ***F28F 1/00*** | (2006.01) |
| ***F16B 17/00*** | (2006.01) |
| ***F22B 29/06*** | (2006.01) |
| ***F28F 9/013*** | (2006.01) |
| ***F28D 7/08*** | (2006.01) |
| *F22B 37/00* | (2006.01) |

(52) U.S. Cl.

CPC ..... *F28F 1/00* (2013.01); *F28F 9/0131* (2013.01); *F28F 9/26* (2013.01); *F22B 37/001* (2013.01); *Y10T 29/4935* (2015.01); *Y10T 403/70* (2015.01); *Y10T 403/7075* (2015.01)

(58) Field of Classification Search

USPC ..... 165/144, 175

See application file for complete search history.

(56) References Cited

U.S. PATENT DOCUMENTS

| | | | | |
|---|---|---|---|---|
| 505,735 | A | 9/1893 | Vanes | |
| 1,256,220 | A | 2/1918 | Fulton | |
| 1,521,864 | A | 1/1925 | Broido | |
| 1,569,050 | A | 1/1926 | Swartz, Jr. | |
| 1,764,981 | A | 6/1930 | Rehfuss | |
| 1,814,447 | A | 7/1931 | Jones | |
| 1,827,946 | A | 10/1931 | Mayr | |
| 1,884,778 | A | 10/1932 | Lucke et al. | |
| 1,895,220 | A | 1/1933 | Grebe | |
| 1,924,850 | A | 8/1933 | Freiday | |
| 1,965,427 | A | 7/1934 | Nerad | |
| 2,800,887 | A | 7/1957 | Profos | |
| 2,847,192 | A | 8/1958 | Smith et al. | |
| 3,004,529 | A | 10/1961 | Argersinger et al. | |
| 3,368,534 | A | 2/1968 | Gorzegno et al. | |
| 3,447,602 | A | 6/1969 | Dalin | |
| 3,789,806 | A | 2/1974 | Gorzegno | |
| 3,854,455 | A | 12/1974 | Carson et al. | |
| 3,896,874 | A * | 7/1975 | Bongaards | F22B 37/24 122/510 |
| 4,246,872 | A | 1/1981 | Skinner et al. | |
| 4,290,389 | A | 9/1981 | Palchik | |
| 4,331,105 | A | 5/1982 | Kawamura et al. | |
| 4,336,642 | A | 6/1982 | Engelberts | |
| 4,532,985 | A | 8/1985 | Cutler | |
| 4,638,857 | A * | 1/1987 | Fournier | 165/162 |
| 4,676,305 | A * | 6/1987 | Doty | 165/158 |
| 4,915,062 | A | 4/1990 | Dolezal | |
| 4,976,310 | A * | 12/1990 | Jabs | 165/82 |
| 5,097,819 | A | 3/1992 | Talbert et al. | |
| 5,265,129 | A | 11/1993 | Brooks et al. | |
| 5,293,842 | A | 3/1994 | Loesel | |
| 5,366,452 | A | 11/1994 | Widlund et al. | |
| 5,398,644 | A | 3/1995 | Nilsson et al. | |
| 5,412,936 | A | 5/1995 | Lee et al. | |
| 5,540,276 | A * | 7/1996 | Adams | F28F 1/32 165/150 |
| 5,628,183 | A | 5/1997 | Rice | |
| 6,019,070 | A | 2/2000 | Duffy | |
| 6,055,803 | A | 5/2000 | Mastronarde | |
| 6,062,017 | A | 5/2000 | Liebig | |
| 6,173,679 | B1 | 1/2001 | Bruckner et al. | |
| 6,189,491 | B1 | 2/2001 | Wittchow et al. | |
| 6,244,330 | B1 | 6/2001 | Eisinger et al. | |
| 6,311,647 | B1 | 11/2001 | Liebig et al. | |
| 6,557,500 | B1 | 5/2003 | Schroeder | |
| 6,820,685 | B1 * | 11/2004 | Carter | F28B 1/06 165/150 |
| 6,868,807 | B2 | 3/2005 | Franke et al. | |
| 6,957,630 | B1 | 10/2005 | Mastronarde | |
| 7,017,529 | B1 * | 3/2006 | Lomax, Jr. | F22B 1/02 122/235.15 |
| 7,270,086 | B2 | 9/2007 | Franke et al. | |
| 7,281,499 | B2 | 10/2007 | Franke et al. | |
| 7,428,374 | B2 | 9/2008 | Franke et al. | |
| 7,770,544 | B2 | 8/2010 | Viskup, Jr. | |
| 7,886,538 | B2 | 2/2011 | Schottler et al. | |
| 7,963,097 | B2 | 6/2011 | Mastronarde | |
| 8,267,051 | B2 | 9/2012 | Ando | |
| 8,635,976 | B2 | 1/2014 | Gayheart et al. | |
| 2003/0051501 | A1 * | 3/2003 | Matsushima et al. | 62/435 |
| 2003/0164232 | A1 * | 9/2003 | Inoue | F28F 9/02 165/148 |
| 2004/0069244 | A1 | 4/2004 | Schroeder | |
| 2005/0194120 | A1 | 9/2005 | Lomax, Jr. et al. | |
| 2007/0084418 | A1 | 4/2007 | Gurevich | |
| 2007/0119388 | A1 | 5/2007 | Waseda et al. | |
| 2008/0104960 | A1 * | 5/2008 | Lomax | F22B 21/16 60/653 |
| 2008/0121387 | A1 | 5/2008 | Taniguchi et al. | |
| 2008/0190382 | A1 | 8/2008 | Bruckner et al. | |
| 2009/0071419 | A1 | 3/2009 | Franke et al. | |
| 2009/0241859 | A1 | 10/2009 | Bairley et al. | |
| 2011/0056668 | A1 | 3/2011 | Taras et al. | |
| 2011/0162594 | A1 | 7/2011 | Brueckner et al. | |
| 2011/0225972 | A1 | 9/2011 | Bruckner et al. | |
| 2011/0239961 | A1 | 10/2011 | Bauver, II et al. | |
| 2012/0180739 | A1 | 7/2012 | Rop et al. | |
| 2014/0216365 | A1 | 8/2014 | Rancruel et al. | |

FOREIGN PATENT DOCUMENTS

| | | | |
|---|---|---|---|
| CN | 2429730 | Y | 5/2001 |
| CN | 1546191 | A | 11/2004 |
| CN | 1599853 | A | 3/2005 |
| CN | 1745277 | A | 3/2006 |
| CN | 101311624 | A | 11/2008 |
| CN | 101457978 | A | 6/2009 |
| CN | 201277766 | Y | 7/2009 |
| CN | 201476631 | U | 5/2010 |
| CN | 101726202 | A | 6/2010 |
| CN | 101784861 | A | 7/2010 |
| CN | 102128557 | A | 7/2011 |
| CN | 102239363 | A | 11/2011 |
| DE | 612960 | C | 5/1935 |
| EP | 0147407 | B1 | 6/1988 |
| FR | 1324002 | A | 4/1963 |
| GB | 28236 | | 0/1913 |
| GB | 104356 | A | 2/1917 |
| GB | 490457 | A | 8/1938 |
| GB | 717420 | A | 10/1954 |
| GB | 865426 | A | 4/1961 |
| GB | 913010 | A | 12/1962 |
| JP | 275806 | A | 3/1990 |
| JP | H0645154 | B2 | 6/1994 |
| JP | 0663606 | B2 | 8/1994 |
| JP | 6229503 | A | 8/1994 |
| JP | H06-341604 | | 12/1994 |
| JP | H09243002 | A | 9/1997 |
| JP | 2000-018501 | | 1/2000 |
| JP | 2002206888 | A | 7/2002 |
| JP | 2008180501 | A | 8/2008 |
| KR | 100284392 | B1 | 4/2001 |
| KR | 20010090529 | A | 10/2001 |
| KR | 20060132944 | A | 12/2006 |
| KR | 20070088654 | A | 8/2007 |
| KR | 20080033268 | A | 4/2008 |
| KR | 20110009042 | U | 9/2011 |
| WO | 2004/011046 | A1 | 2/2004 |
| WO | 2007093453 | A2 | 8/2007 |
| WO | 2007/133071 | A2 | 11/2007 |

(56) References Cited

FOREIGN PATENT DOCUMENTS

OTHER PUBLICATIONS

Indonesian Notification of Substantive Examination's Result for ID Appln. No. W00201302867 dated Nov. 5, 2015.
International Search Report and Written Opinion issued in connection with related PCT Application No. PCT/IB2013/050457 dated Feb. 20, 2014.
Unofficial translation of Korean Office Action issued in connection with related KR Application No. 10-2013-7019920 on Aug. 8, 2014.
Unofficial translation Chinese Office Action and Search Report issued in connection with related CN Application No. 201380000532.9 on Jan. 14, 2015.
Unofficial translation of Korean Office Action issued in connection with related KR Application No. 10-2013-7021217 on Jan. 23, 2015.
Unofficial translation of Korean Notice of Allowance issued in connection with related KR Application No. 10-2013-7019920 dated Apr. 27, 2015.
Notice of Allowance issued in connection with related U.S. Appl. No. 13/744,104 dated May 20, 2015.
Unofficial translation Chinese Office Action and Search Report issued in connection with related CN Application No. 201380000531.4 on May 27, 2015.
Non-Final Rejection towards related U.S. Appl. No. 13/744,121 dated Sep. 28, 2015.
Unofficial translation of Korean Notice of Allowance issued in connection with related KR Application No. 10-2013-7021217 dated Nov. 27, 2015.
Unofficial translation of Chinese Office Action and Search Report issued in connection with related CN Application No. 201380000531.4 on Dec. 24, 2015.
Unofficial translation of Chinese Office Action and Search Report issued in connection with corresponding CN Application No. 201380000530.X on Apr. 25, 2016.
Final Rejection towards related U.S. Appl. No. 13/744,121 dated May 20, 2016.
Unofficial translation of Chinese Office Action and Search Report issued in connection with related CN Application No. 201380000533.3 on Mar. 17, 2015.
Unofficial translation of Korean Office Action issued in connection with related KR Application No. 2013-7021477 on Jan. 23, 2015.
Unofficial translation of Korean Office Action issued in connection with related KR Application No. 2013-7021477 on Feb. 24, 2016.
U.S. Appl. No. 61/587,402, filed Jan. 17, 2012, Wilhelm et al.
U.S. Appl. No. 61/587,359, filed Jan. 17, 2012, Wilhelm et al.
U.S. Appl. No. 13/744,121, filed Jan. 17, 2013, Wilhelm et al.
U.S. Appl. No. 61/587,332, filed Jan. 17, 2012, Magee et al.
U.S. Appl. No. 61/587,428, filed Jan. 17, 2012, Magee.
U.S. Appl. No. 13/744,104, filed Jan. 17, 2013, Magee.
U.S. Appl. No. 61/587,230, filed Jan. 17, 2012, Pschirer.
U.S. Appl. No. 13/744,126, filed Jan. 17, 2013, Lech et al.
U.S. Appl. No. 13/744,112, filed Jan. 17, 2013, Truong et al.
US Non-Final Office Action issued in connection with related U.S. Appl. No. 13/744,126 on Jul. 28, 2016.
US Final Office Action issued in connection with related U.S. Appl. No. 13/744,126 on Feb. 7, 2017.

* cited by examiner 200
(hot gas flow)
210an
204
252
250
206
Top view
From
inlet manifold
Front view
210an
210a3
210a2
210a1
210
To outlet manifold
Side view (Front View)

250
200
Gas Flow
210(n)
210(n+1)
204(n)
204(n+1)
206(n+1)
206(n)

204(n)
210(n)
239
240
200
206(n+1)
206(n)
210(n+8)
204(n+8)
270
Fractional stack
206(n+8)
Gas Flow
239

METHOD AND APPARATUS FOR CONNECTING SECTIONS OF A ONCE-THROUGH HORIZONTAL EVAPORATOR

CROSS-REFERENCE TO RELATED APPLICATIONS

This disclosure claims priority to U.S. Provisional Application No. 61/587,332 filed Jan. 17, 2012, U.S. Provisional Application No. 61/587,230 filed Jan. 17, 2012, U.S. Provisional Application No. 61/587,428 filed Jan. 17, 2012, U.S. Provisional Application No. 61/587,359 filed Jan. 17, 2012, and U.S. Provisional Application No. 61/587,402 filed Jan. 17, 2012, the entire contents of which are all hereby incorporated by reference.

TECHNICAL FIELD

The present disclosure relates generally to a heat recovery steam generator (HRSG), and more particularly, to a method and apparatus for connecting sections of a once-through evaporator of an HRSG having substantially horizontal and/or horizontally inclined tubes for heat exchange.

BACKGROUND

A heat recovery steam generator (HRSG) is an energy recovery heat exchanger that recovers heat from a hot gas stream. It produces steam that can be used in a process (cogeneration) or used to drive a steam turbine (combined cycle). Heat recovery steam generators generally comprise four major components—the economizer, the evaporator, the superheater and the water preheater. In particular, natural circulation HRSG's contain an evaporator heating surface, a drum, as well as piping to facilitate an appropriate circulation rate in the evaporator tubes. A once-through HRSG replaces the natural circulation components with the once-through evaporator and in doing so offers in-roads to higher plant efficiency and furthermore assists in prolonging the HRSG lifetime in the absence of a thick walled drum.

An example of a once-through evaporator heat recovery steam generator (HRSG) 100 is shown in the FIG. 1. In the FIG. 1, the HRSG comprises vertical heating surfaces in the form of a series of vertical parallel flow paths/tubes 104 and 108 (disposed between the duct walls 111) configured to absorb the required heat. In the HRSG 100, a working fluid (e.g., water) is transported to an inlet manifold 105 from a source 106. The working fluid is fed from the inlet manifold 105 to an inlet header 112 and then to a first heat exchanger 104, where it is heated by hot gases from a furnace (not shown) flowing in the horizontal direction. The hot gases heat tube sections 104 and 108 disposed between the duct walls 111. A portion of the heated working fluid is converted to a vapor and the mixture of the liquid and vaporous working fluid is transported to the outlet manifold 103 via the outlet header 113, from where it is transported to a mixer 102, where the vapor and liquid are mixed once again and distributed to a second heat exchanger 108. This separation of the vapor from the liquid working fluid is undesirable as it produces temperature gradients and efforts have to be undertaken to prevent it. To ensure that the vapor and the fluid from the heat exchanger 104 are well mixed, they are transported to a mixer 102, from which the two phase mixture (vapor and liquid) are transported to another second heat exchanger 108 where they are subjected to superheat conditions. The second heat exchanger 108 is used to overcome thermodynamic limitations. The vapor and liquid are then discharged to a collection vessel 109 from which they are then sent to a separator 110, prior to being used in power generation equipment (e.g., a turbine). The use of vertical heating surfaces thus has a number of design limitations.

Due to design considerations, it is often the case that thermal head limitations necessitate an additional heating loop in order to achieve superheated steam at the outlet. Often times additional provisions are needed to remix water/steam bubbles prior to re-entry into the second heating loop, leading to additional design considerations. In addition, there exists a gas-side temperature imbalance downstream of the heating surface as a direct result of the vertically arranged parallel tubes. These additional design considerations utilize additional engineering design and manufacturing, both of which are expensive. These additional features also necessitate periodic maintenance, which reduces time for the productive functioning of the plant and therefore result in losses in productivity. It is therefore desirable to overcome these drawbacks.

SUMMARY

Disclosed herein is a once-through evaporator comprising an inlet manifold; one or more inlet headers in fluid communication with the inlet manifold; one or more tube stacks, where each tube stack comprises one or more substantially horizontal evaporator tubes; the one or more tube stacks being in fluid communication with the one or more inlet headers; one or more outlet headers in fluid communication with one or more tube stacks; and an outlet manifold in fluid communication with the one or more outlet headers.

Disclosed herein too is a method comprising discharging a working fluid through a once-through evaporator; where the once-through evaporator comprises an inlet manifold; one or more inlet headers in fluid communication with the inlet manifold; one or more tube stacks, where each tube stack comprises one or more substantially horizontal evaporator tubes; the one or more tube stacks being in fluid communication with the one or more inlet headers; one or more outlet headers in fluid communication with the one or more tube stacks; and an outlet manifold in fluid communication with the one or more outlet headers; and discharging a hot gas from a furnace or boiler through the once-through evaporator; where a direction of flow of hot gas is perpendicular to a direction of flow of the working fluid; and transferring heat from the hot gas to the working fluid.

Disclosed herein too is a method of manufacturing a once-through evaporator comprising assembling a plurality of tubes to form a tube stack; where each tube stack is supported by a plate; the plate having holes in which the tubes are disposed; contacting an inlet header and an outlet header with the tube stack such that fluid from the inlet header can travel through the tube stack to the outlet header; and contacting the inlet header with an inlet manifold; and contacting the outlet header with an outlet manifold; such that the fluid can travel from the inlet manifold to the outlet manifold via the tube stack.

Disclosed herein too is a connector assembly for attaching a pair of vertically stacked evaporator sections having a plurality of plates; the connector assembly comprising:

a plurality of clevis plates having an upper and lower portion, wherein an upper portion of the clevis plates are attached to the lower portion of the plates, wherein the lower portion includes a through hole, a plurality of connecting pins that passes through holes disposed in the plate and a respective clevis plate to secure the plates of the pair of the vertically stacked evaporator sections.

BRIEF DESCRIPTION OF THE DRAWINGS

Referring now to the Figures, which are exemplary embodiments, and wherein the like elements are numbered alike.

DETAILED DESCRIPTION

Disclosed herein is a heat recovery steam generator (HRSG) that comprises a single heat exchanger or a plurality of heat exchangers whose tubes are arranged to be non-vertical. In one embodiment, the tubes are arranged to be substantially horizontal. By "substantially horizontal" it is implies that the tubes are oriented to be approximately horizontal (i.e., arranged to be parallel to the horizon within ±2 degrees). The section (or plurality of sections) containing the horizontal tubes is also termed a "once-through evaporator", because when operating in subcritical conditions, the working fluid (e.g., water, ammonia, or the like) is converted into vapor gradually during a single passage through the section from an inlet header to an outlet header. Likewise, for supercritical operation, the supercritical working fluid is heated to a higher temperature during a single passage through the section from the inlet header to the outlet header. The section of horizontal tubes is hereinafter referred to as a "tube stack".

The once-through evaporator (hereinafter "evaporator") comprises parallel tubes that are disposed horizontally in a direction that is perpendicular to the direction of flow of heated gases emanating from a furnace or boiler. Other devices (e.g., a turbine) than a boiler or furnace can be used to generate the hot gases. In other words, every tube of the tube stack in a given vertical plane taken across a particular tube stack experiences approximately the same temperature or heat profile. The tubes in a succeeding vertical plane that is contacted later by the hot gases may therefore experience a lower temperature or heat profile than the tubes in a preceding vertical plane that first contacts the hot gases.

This arrangement is advantageous in that it permits a uniform working fluid flow distribution within the tubes. This is primarily because the horizontal flow of the working fluid minimizes the non-uniform distribution of liquid and vapors within the tube stack. In addition, the overall effectiveness is enhanced relative to the aforementioned vertical tube arrangement in that counterflow heat transfer is more dominant.

Figure 1:
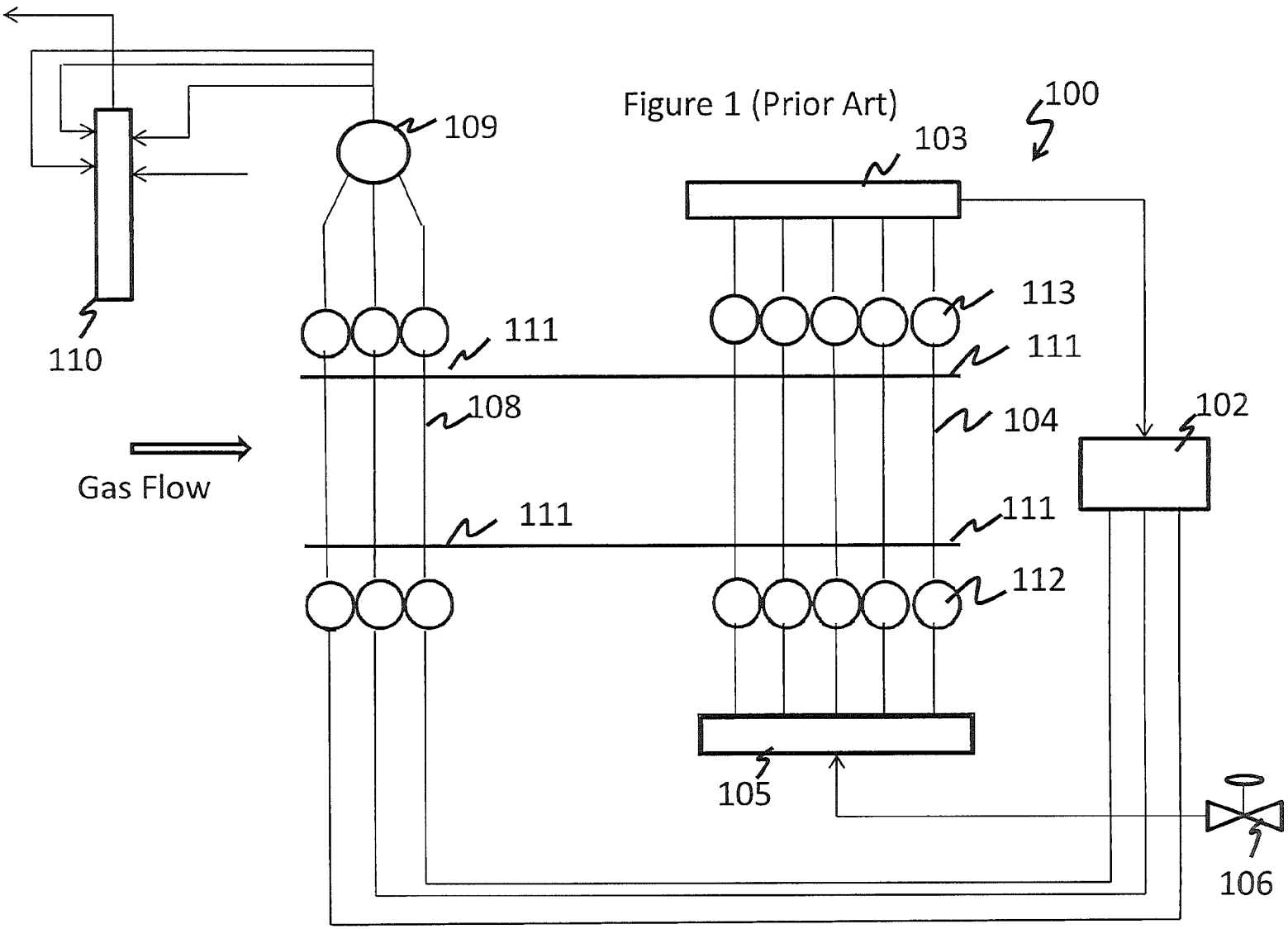
Figure 1 (Prior Art)
FIG. 1 is a schematic view of a heat recovery steam generator having vertical heat exchanger tubes.
Figure 2:
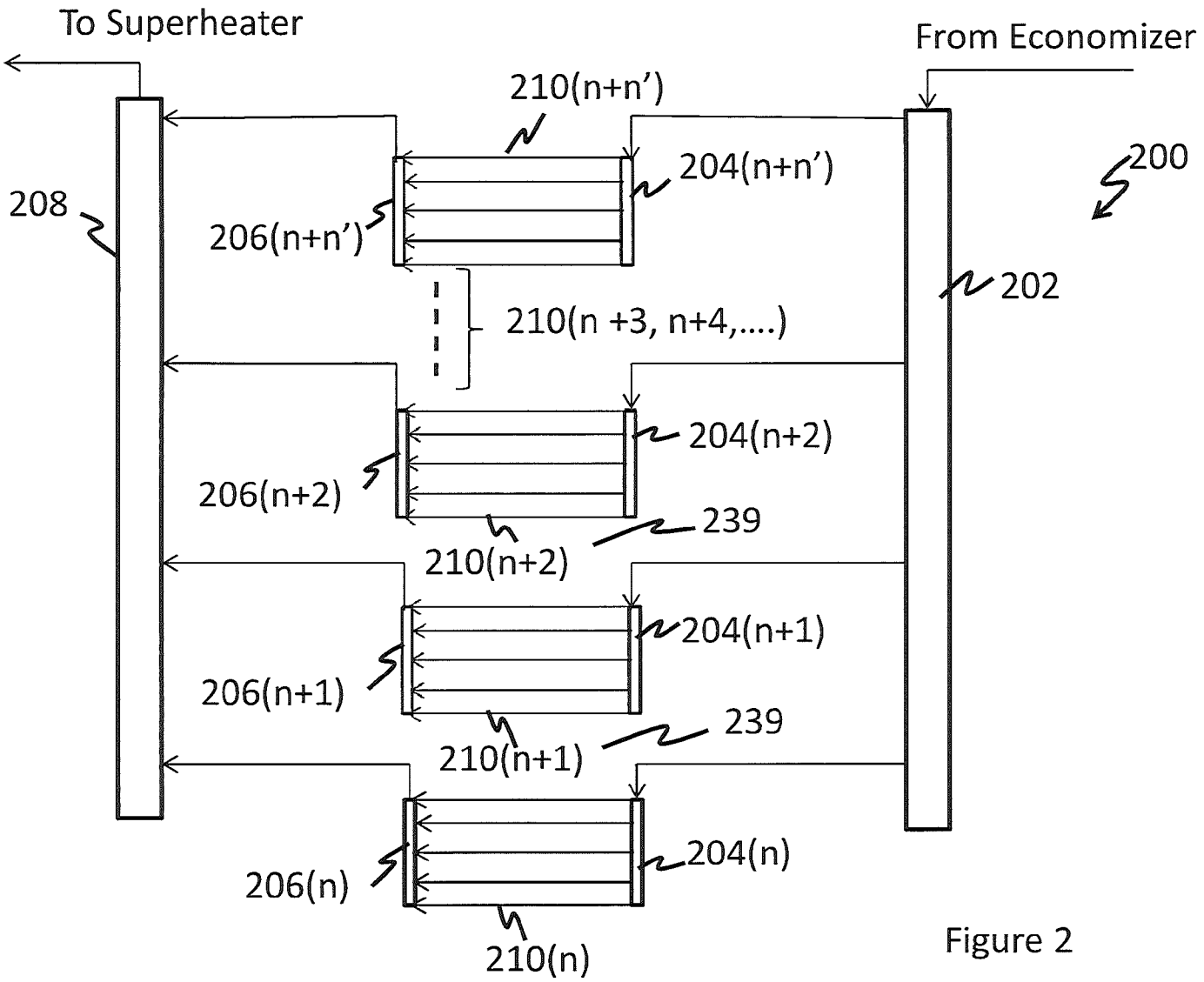
FIG. 2 depicts a schematic view of an exemplary once-through evaporator.

FIGS. 2, 3, 4(A) and 4(B) depict a plurality of tube stacks, a single tube stack in one exemplary configuration and another single tube stack in another exemplary configuration respectively. The following description references the FIGS. 2, 3 and 4(A). The FIG. 2 is a schematic depiction of an exemplary once-through evaporator 200. The evaporator 200 comprises an inlet manifold 202, which receives a working fluid from an economizer (not shown) and transports the working fluid to an inlet header 204 (See FIGS. 3 and 4(A).) or to a plurality of inlet headers 204(*n*), each of which are in fluid communication with a vertically arranged tube stacks 210(*n*) comprising one or more substantially horizontal tubes 210 (See FIGS. 3 and 4(A).). It is to be noted that while the FIGS. 2, 5, and so on each show a plurality of inlet headers 204(*n*), 204(*n*+1) . . . and 204(*n*+*n*'), these will be collectively referred to as 204(*n*), except in cases where a specific header is referred to. In such cases, the specific header 204(*n*+1), 204(*n*+2), and so on will be referred to. Similarly the plurality of tube stacks 210(*n*), 210(*n*+1), 210(*n*+2) . . . and 210(*n*+*n*') are collectively referred to as 210(*n*) and the plurality of outlet headers 206(*n*), 206(*n*+1), 206(*n*+2) . . . and 206(*n*+*n*') are collectively referred to as 206(*n*). In the FIG. 2, there is a plurality of tube stacks that are vertically disposed atop each other and have a passage 239 between adjacent tube stacks. The passage permits the hot gases to by-pass the tube stacks. As will be detailed later, the tube stacks may be vertically arranged to prevent this bypass.

As can be seen in the FIGS. 2, 3, 4(A) and 4(B), each individual tube stack 210(*n*) is disposed between the respective inlet header 204(*n*) and an outlet header 206(*n*). Multiple inlet tube stacks 210(*n*) are therefore respectively vertically aligned between a plurality of inlet headers 204(*n*) and outlet headers 206(*n*). Each tube of the tube stack 210(*n*) is supported by a plate or a plurality of plates 250. (See FIGS. 3 and 4(A)) The plate 250 has a plurality of holes arranged in staggered or inline configurations, each of which support the individual tubes of the tube stack that pass through it. There are generally two or more plates 250 that support the tubes between the inlet header 204(*n*) and the outlet header 206(*n*). The working fluid upon traversing the tube stack 210(*n*) is discharged to the outlet header 206(*n*), from which it is disposed to the outlet manifold 208. It is then discharged from the outlet manifold 208 to the superheater. The inlet manifold 202 and the outlet manifold 208 can be horizontally disposed or vertically disposed depending upon space requirements for the once-through evaporator 200. The FIG. 2 shows a vertical inlet manifold 202 which is in fluid communication with the tube stacks 210(*n*).

Figure 3:
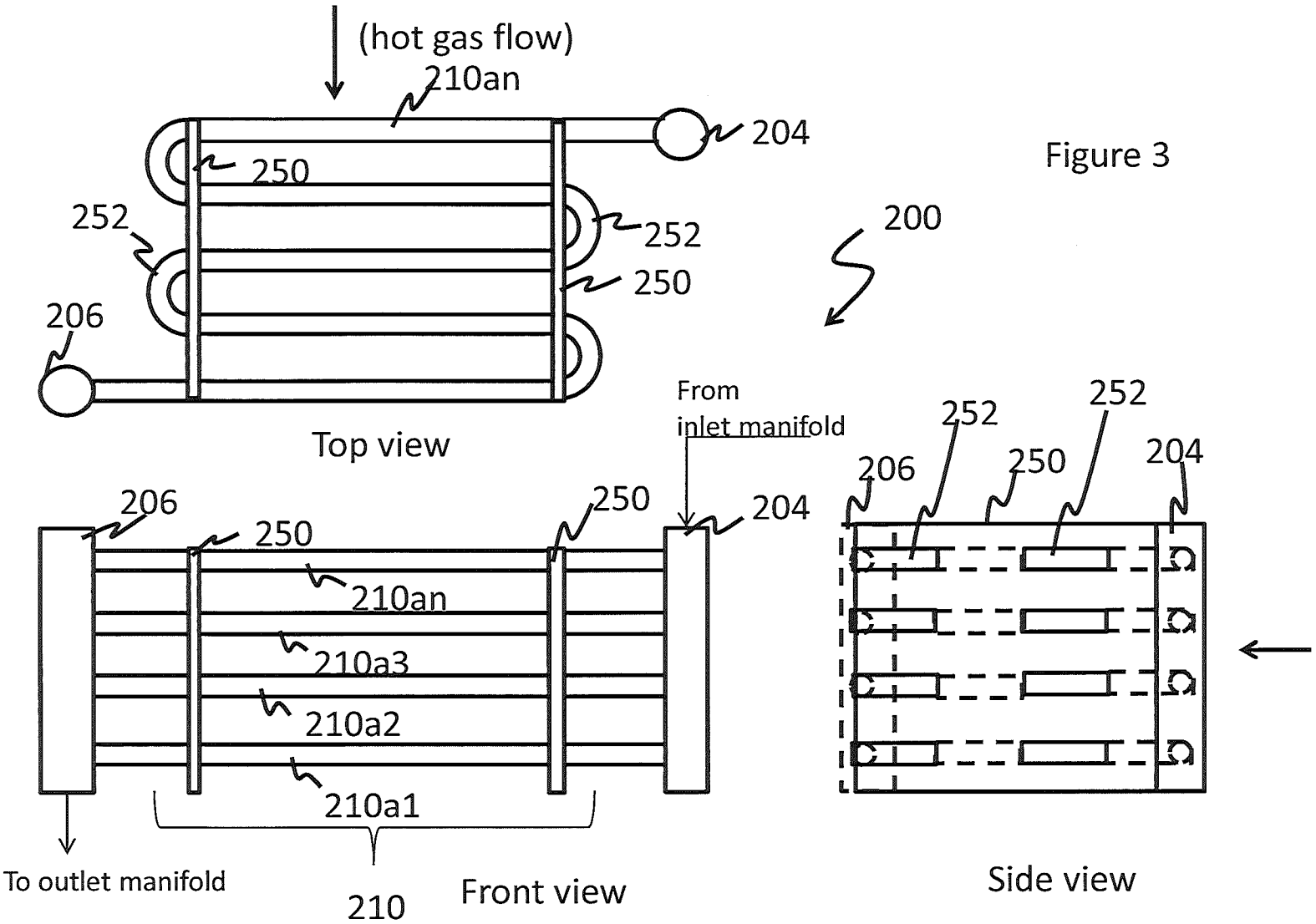
FIG. 3 depicts a front view, a top view and a side view of a single tube stack of a once-through evaporator.
Figure 4A:
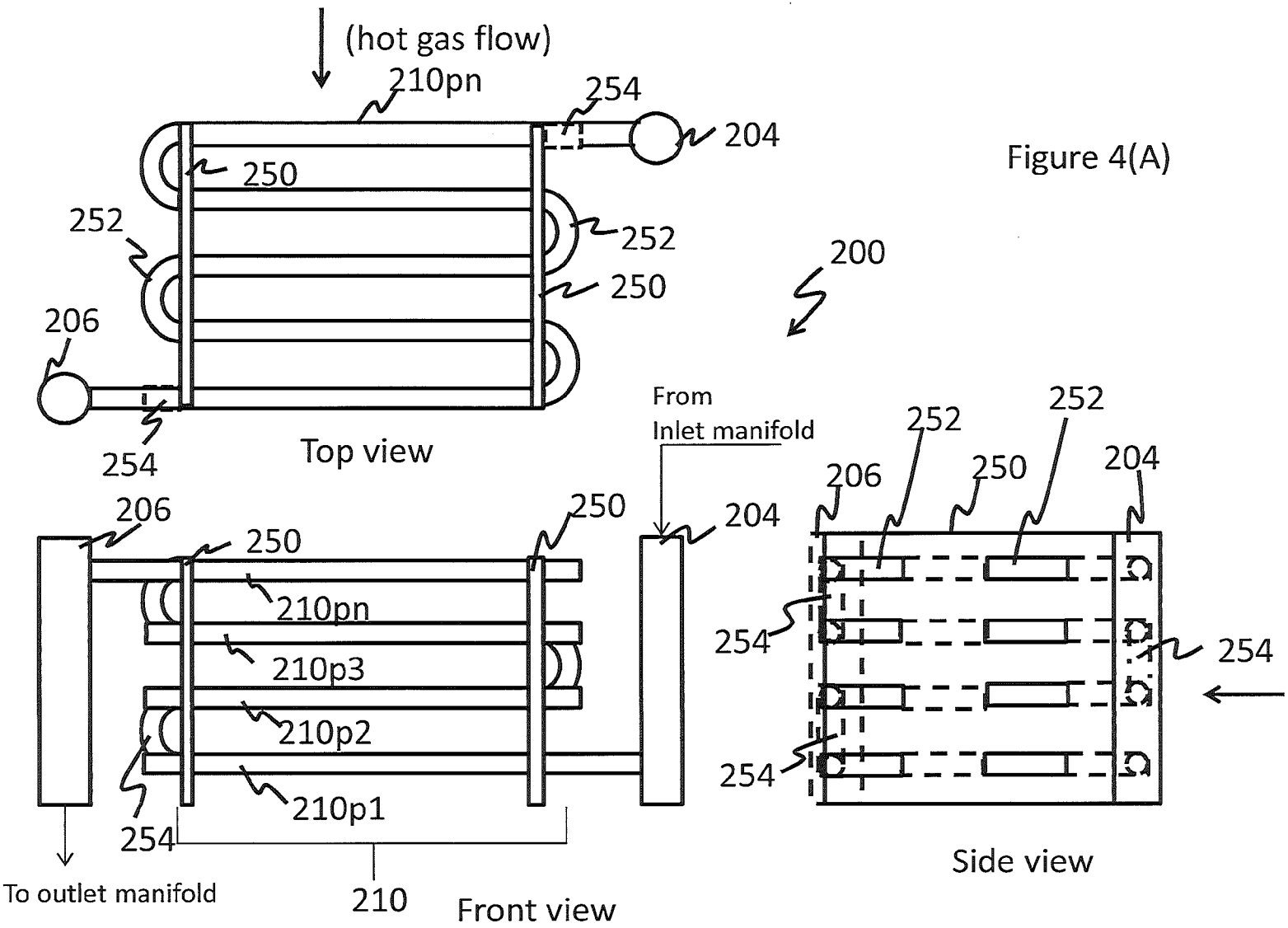
FIG. 4(A) depicts another front view, a top view and a side view of a single tube stack of a once-through evaporator.

While the FIGS. 2, 3 and 4(A) show the inlet header and the outlet header being on opposite sides of the tube stack, they may both be disposed on the same sides of the stack. In addition, while the side view of the FIGS. 3 and 4(A) show the hot gases flowing from right to left, the hot gases can flow from left to right as well.

The hot gases from a furnace or boiler (not shown) travel perpendicular to the direction of the flow of the working fluid in the tubes 210. The hot gases travel into and out of the plane of the paper. The side view in the FIGS. 3 and 4A clearly show the direction of travel of the hot gases relative to the tubes in a tube stack 210(*n*). The hot gases therefore flow towards or away from the reader. All tubes in a given vertical plane in the tube stack are thus subjected to the same heat profile. Heat is transferred from the hot gases to the working fluid to increase the temperature of the working fluid and to possibly convert some or all of the working fluid from a liquid to a vapor. Details of each of the components of the once-through evaporator are provided below.

To summarize (as seen in the FIG. 2), the inlet header comprises or more inlet headers 204(*n*), 204(*n*+1) . . . and 204(*n*) (hereinafter represented generically by the term "204(*n*)"), each of which are in operative communication with an inlet manifold 202. In one embodiment, each of the one or more inlet headers 204(*n*) are in fluid communication with an inlet manifold 202. The inlet headers 204(*n*) are in fluid communication with a plurality of horizontal tube stacks 210(*n*), 210(*n*+1), 210(*n'*+2) . . . and 210(*n*+*n*') respectively ((hereinafter termed "tube stack" represented generically by the term "210(*n*)"). Each tube stack 210(*n*) is in fluid communication with an outlet header 206(*n*). The outlet header thus comprises a plurality of outlet headers 206(*n*), 206(*n*+1), 206(*n*+2) . . . and 206(*n*+*n*'), each of which is in fluid communication with a tube stack 210(*n*), 210(*n*+1), 210(*n*+2) . . . and 210(*n*+*n*') and an inlet header 204(*n*), 204(*n*+1), 204(*n*+2) . . . and 204(*n*+*n*') respectively.

The term "n" is an integer starting from 1 and proceeding sequentially, while "n'" can either be an integer value that starts from 1 and proceeds sequentially or can be a fractional value. n' can thus be a fractional value such as ½, ⅓, and the like. Thus for example, there can be one or more fractional inlet headers, tube stacks or outlet headers. In other words, there can be one or more inlet headers and/or outlet headers whose size (volume) is a fraction of the other inlet headers and/or outlet headers. Similarly there can be tube stacks that contain a fractional value of the number of tubes that are contained in another stack.

In one embodiment, there can therefore be 2 or more inlet headers in fluid communication with 2 or more tube stacks which are in fluid communication with 2 or more outlet headers. In one embodiment, there can therefore be 3 or more inlet headers in fluid communication with 3 or more tube stacks which are in fluid communication with 3 or more outlet headers. In another embodiment, there can therefore be 5 or more inlet headers in fluid communication with 5 or more tube stacks which are in fluid communication with 5 or more outlet headers. In yet another embodiment, there can therefore be 10 or more inlet headers in fluid communication with 10 or more tube stacks which are in fluid communication with 10 or more outlet headers. There is no limitation to the number of tube stacks, inlet headers and outlet headers that are in fluid communication with each other and with the inlet manifold and the outlet manifold. Each tube stack is also sometimes referred to as a bundle, a zone or a section.

The FIGS. 3 and 4(A) show two different exemplary arrangements of the horizontal tubes in a single tube stack 210(*n*) of the once-through evaporator. FIG. 3 depicts a front view, a top view and a side view of a single tube stack 210(*n*) of a once-through evaporator 200. The tube stack 210(*n*) comprises a plurality of tubes 210*a*1, 210*a*2, 210*a*3, . . . and 210*an*, each of which are supported by one or more plates 250 and are in fluid communication with an inlet header 204(*n*) and an outlet header 206(*n*). In the FIG. 3, the subscript "n" is an integer that can take values from 1 onwards to any desired value. A single tube stack 210(*n*) according to the embodiment depicted in the FIG. 3, can thus comprise 5 or more tubes, 10 or more tubes, and so on, each of which are in fluid communication with the inlet header 204(*n*) and with the outlet header 206(*n*). In the embodiment, shown in the FIG. 4(A), a single tube can travel in multiple different planes, each plane of which vertically is separated from an adjacent plane.

Each tube is serpentine in shape as can be seen in the top view of the FIGS. 3 and 4(A). For example in the top view of the FIG. 3, the tube 210*an* starts at the inlet header 204(*n*), progresses across two plates 250 and then turns through an angle of 180 degrees to travel across the two support plates before turning through 180 degrees in the opposite direction from the first turn. In this manner, the tube 210*an* can progress through multiple turns in a single plane before contacting the outlet header 206. Each tube thus travels in a single horizontal plane and extends from the inlet header 204(*n*) to the outlet header 206(*n*) while traversing several bends 252 that are 180 degrees or greater and where the direction of each successive bend in the tube is opposed to the direction of the preceding bend. Each alternate bend (e.g., the first bend, the third bend, and so on) causes the working fluid flowing in the tube to proceed in a first direction, while each intermediate bend (e.g., the second bend, the fourth bend, and so on) causes the working fluid flowing in the tube to proceed in a second direction that is opposed to the first direction. This type of flow in the tubes is termed counterflow. In an exemplary embodiment, each bend is greater than or equal to about 180 degrees but less than 270 degrees. While the bends are shown to be smooth and semi-circular in the FIG. 3, they can be square bends with each corner encompassing an included angle of 90 degrees. The plurality of tubes 210*a*1, 201*a*2, 201*a*3, and so on shown in the FIG. 3 do not contact one another. The hot gases travel perpendicular to the flow of the working fluid in the tubes.

The FIG. 4(A) depicts an exemplary variation in the tube arrangement from that depicted in the FIG. 3. In the FIG. 4(A), a tube stack 210 comprises a single tube that contacts the inlet header 204 traverses the plates 250 multiple times in successive planes each of which are vertically separated from a preceding or succeeding plane and eventually contacts the outlet header 206. The tube is serpentine (i.e., it bends back and forth using 180 degree horizontal bends 252 in a first plane) and other vertical 180 degree bends to direct the tubes into another plane that is vertically separated from the first plane. This can be seen for the tube 210*p*1 (in the front view of the FIG. 4(A)) which starts at the inlet header 204 and after bending back and forth using horizontal 180 degree bends 252 (see top view which depicts the tube in plane 210*pn* doing the same thing) then bends upwards using vertical bend 254 into the plane represented by 210*p*2, where it bends back and forth (once again using horizontal bends 252) and then bends upwards using another vertical bend 254 into the plane represented by 210*p*3. This continues till the tube contacts the outlet header 206. In this arrangement the horizontal bends 252 and the vertical bends 254 each bend 180 degrees or more thus causing the working fluid to travel in a direction that is opposed to the direction that it traveled prior to the bend. The tube can thus travel through as many planes as desired. In the FIGS. 3 and 4(A), the subscript "n" is an integer that can take values from 1 onwards to any desired value. The term "p" use in the FIG. 4(A) refers to "plane". A tube in the first plane of the FIG. 4(A) is thus referred to as 210*p*1 and the same tube in the second plane of the FIG. 4(A) is referred to as 210*p*2. A stack can thus have a single tube that bends through 5 or more planes, 10 or more planes, and so on.

Figure 4B:
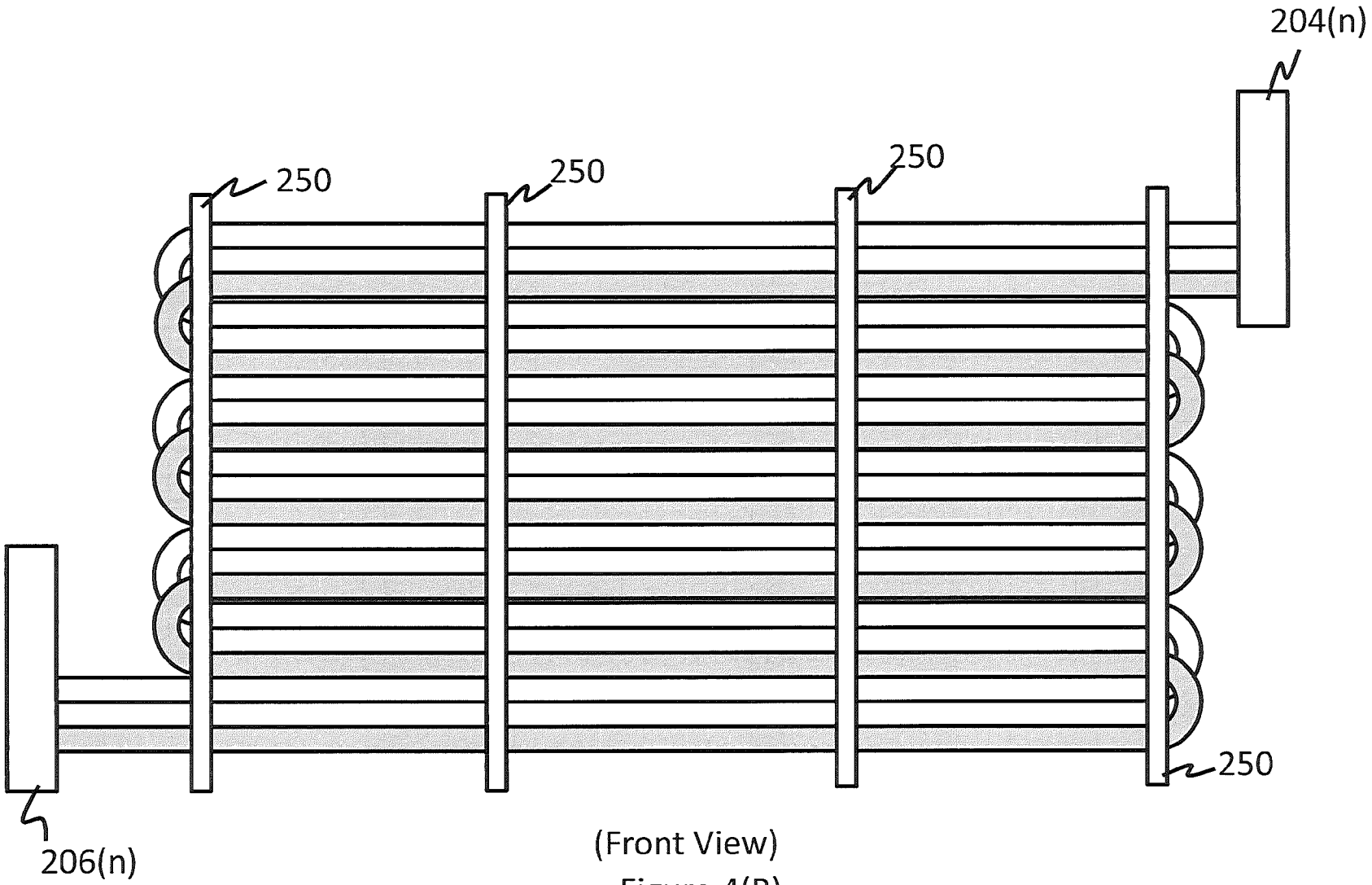
FIG. 4(B) depicts a plurality of tubes in fluid communication with the inlet header 204(*n*) and the outlet header 206(*n*)

In one embodiment depicted in the FIG. 4(B), a plurality of tubes may contact the inlet header 204(*n*), bend several times in a first plane, then travel upwards to a plurality of different horizontal planes (each vertically separated from the preceding and succeeding planes), where they bend back and forth several times in each plane, before contacting the outlet header 206(*n*). The inlet headers 204(*n*) in each of the FIGS. 3, 4(A) and 4(B) receive the working fluid from the inlet manifold and discharge the working fluid to the outlet manifold from the outlet headers 206(*n*).

Figure 5:
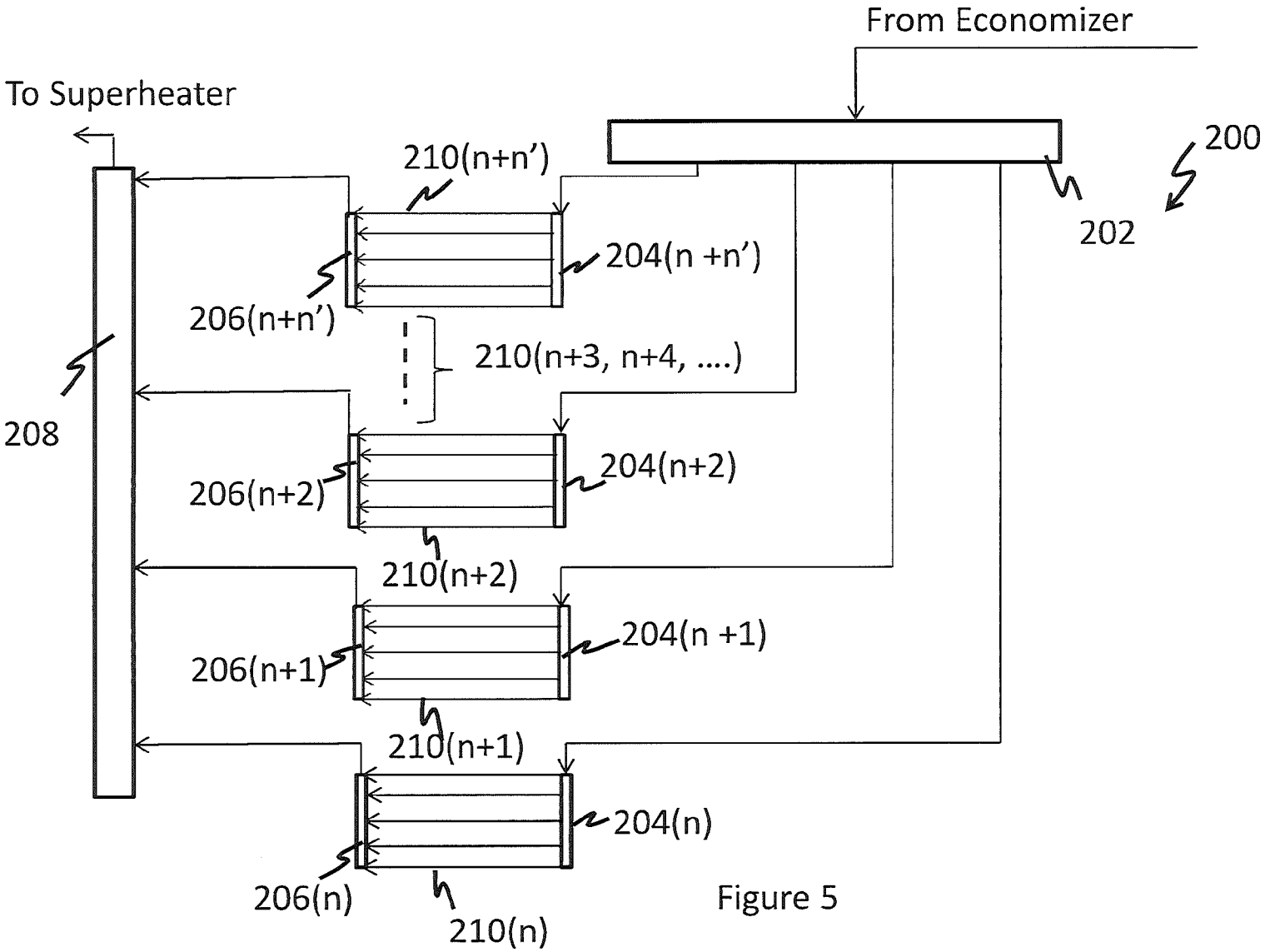
FIG. 5 depicts a design for another once-through evaporator that is similar to the design shown in the FIG. 2, except that the inlet manifold is horizontally disposed.

The FIG. 5 depicts a design for another once-through evaporator that is similar to the design shown in the FIG. 2, except that the inlet manifold is horizontally disposed. The inlet manifold and the outlet manifold can therefore be horizontal or vertical if desired depending upon design and space limitations.

Figure 6:
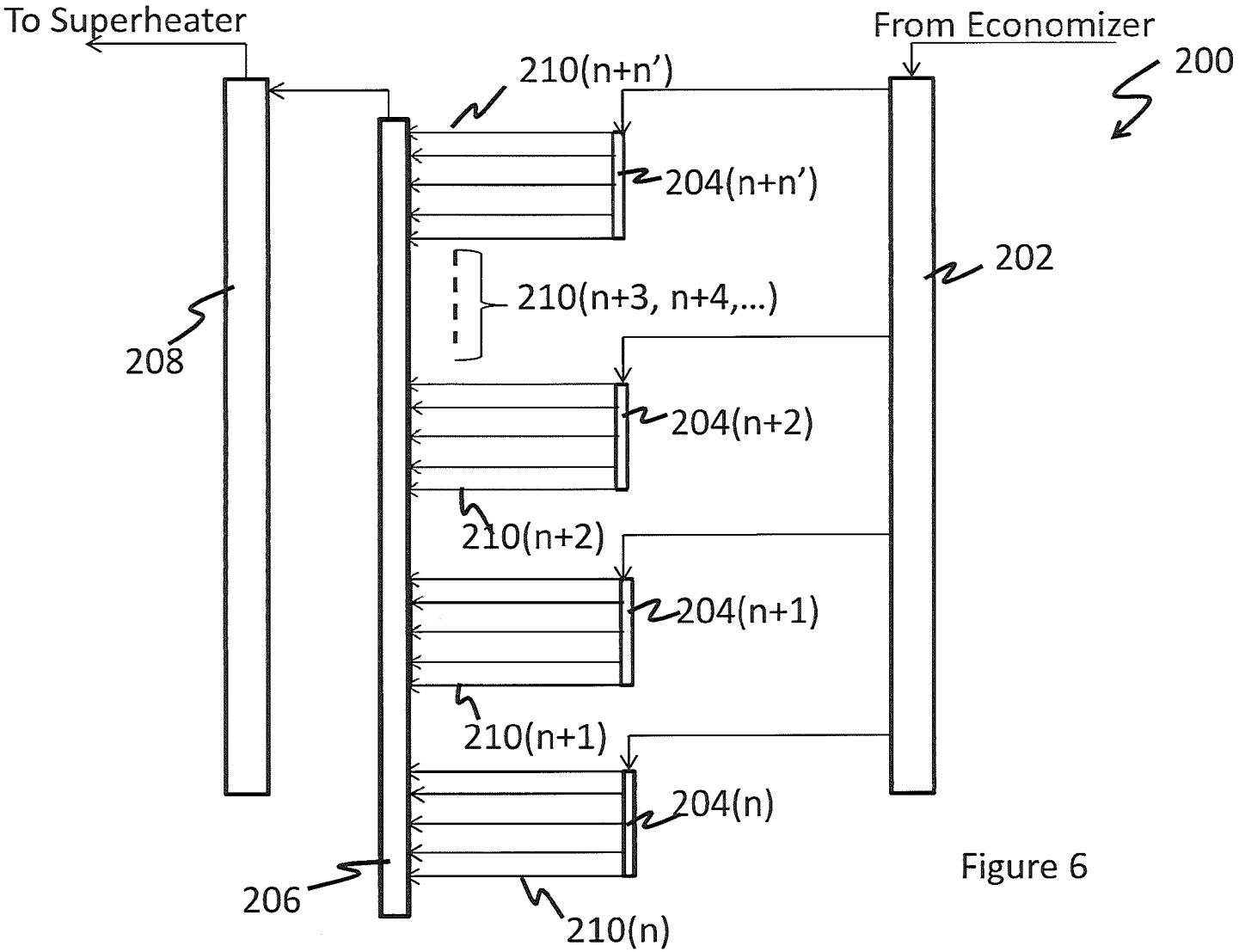
FIG. 6 depicts vertically aligned tube stacks that are in fluid communication with a plurality of inlet headers respectively, while at the same time being in fluid communication with a single outlet header.
Figure 7:
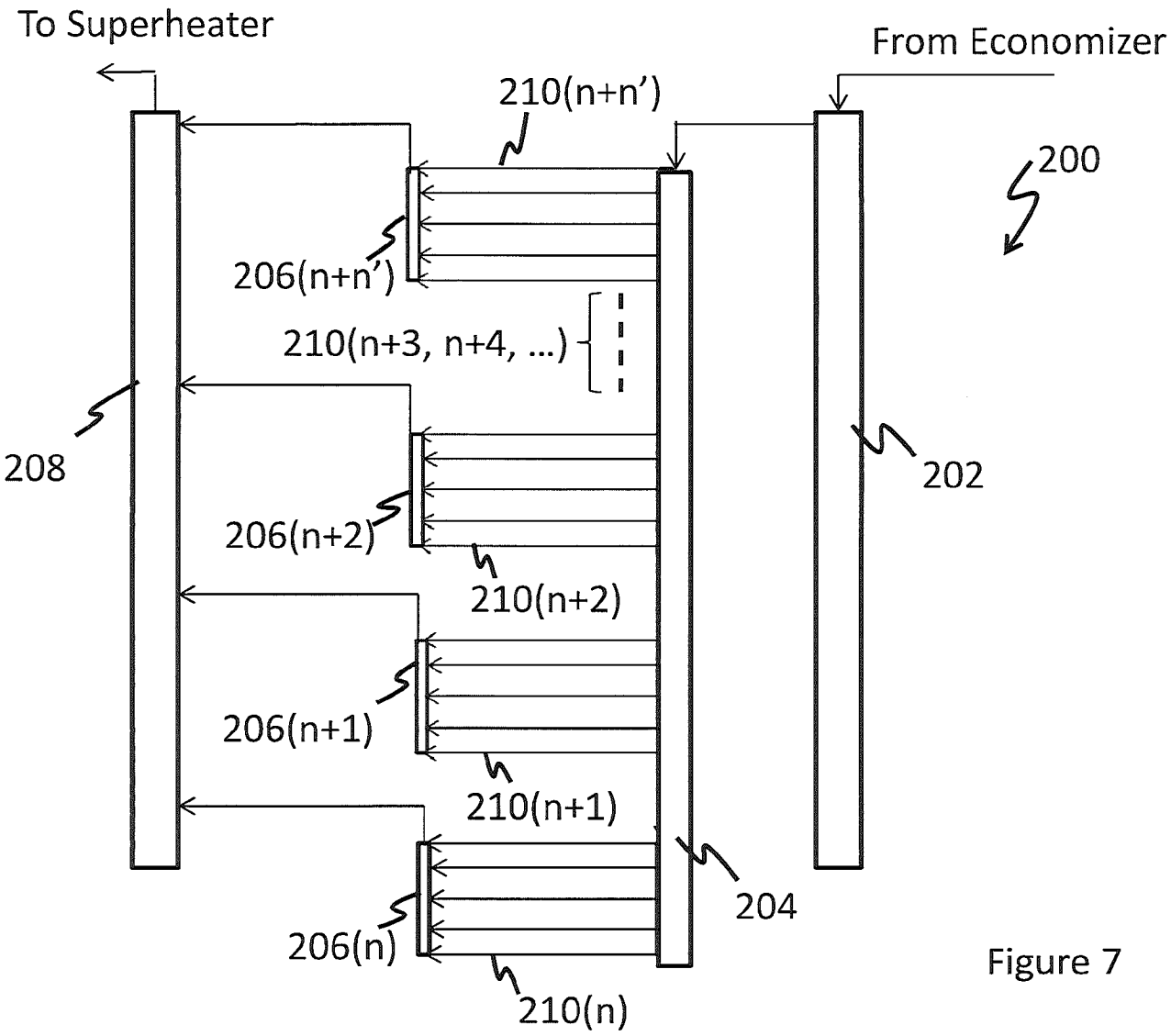
FIG. 7 depicts a plurality of vertically aligned tube stacks that are in fluid communication with a plurality of outlet headers respectively, while at the same time being in fluid communication with a single inlet header.

The FIGS. 6 and 7 depict variations in the arrangement of the vertically aligned stacks in the once-through evaporator. The FIG. 6 depicts vertically aligned tube stacks 210(*n*) that are in fluid communication with a plurality of inlet headers 204(*n*) respectively, while at the same time being in fluid communication with a single outlet header 206. The plurality of inlet headers 204(*n*) receive the working fluid from an economizer via the inlet manifold 202, and the heated working fluid is discharged to the single outlet header 206 and then to the outlet manifold 208. The FIG. 7 depicts a plurality of vertically aligned tube stacks 210(*n*) that are in fluid communication with a plurality of outlet headers 206(*n*) respectively, while at the same time being in fluid communication with a single inlet header 204. The inlet header 204 receives the working fluid from an economizer via the inlet manifold 202, and the heated working fluid is discharged from the plurality of outlet headers 206 to the outlet manifold 208. In the FIGS. 6 and 7, the hot gases from the furnace travel perpendicular to the direction of travel of the working fluid in the tubes.

Figure 8:
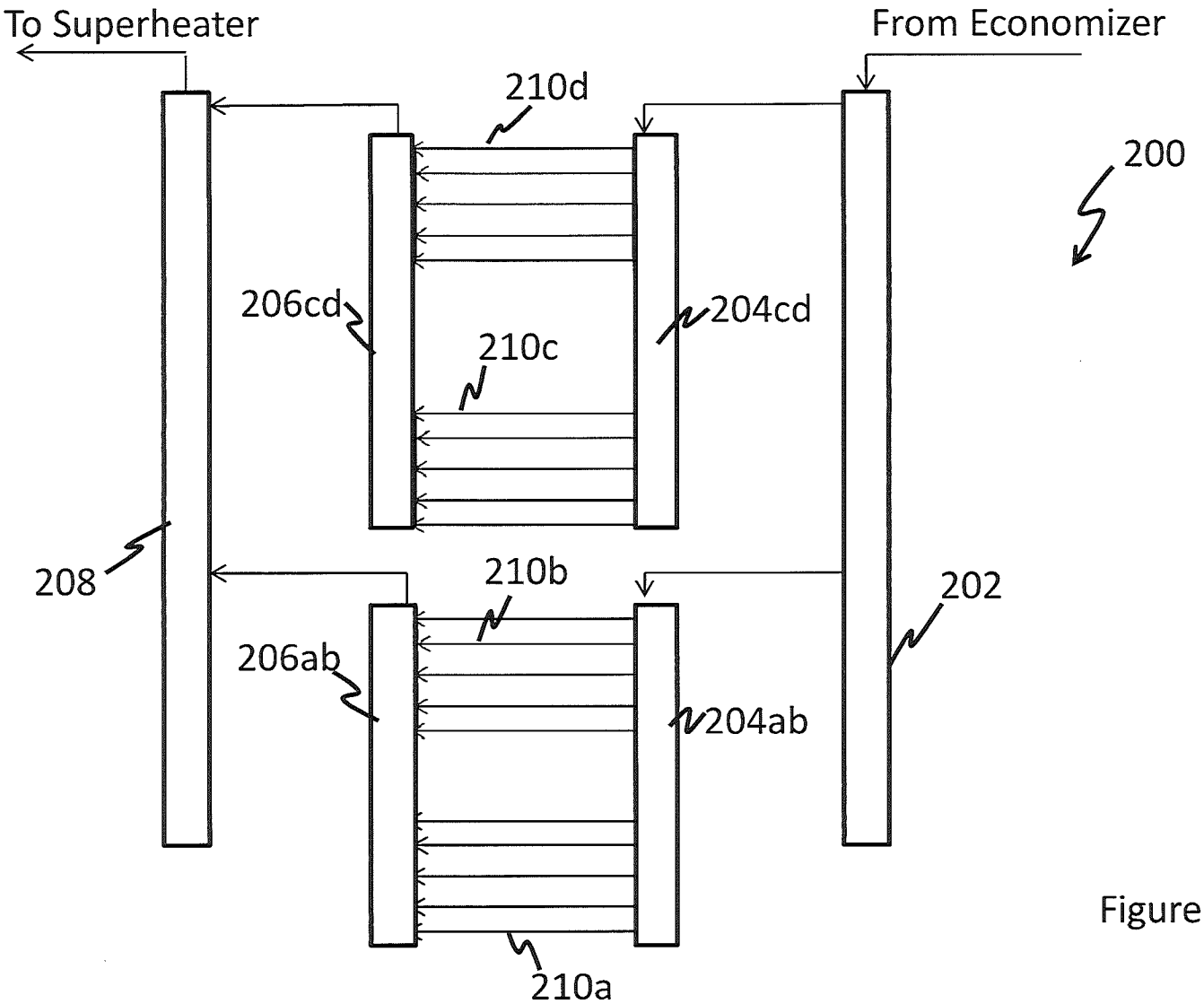
FIG. 8 depicts yet another arrangement of the vertically aligned stacks in the once-through evaporator. In the FIG. 8, two or more vertically aligned tube stacks are in fluid communication with a single inlet header and a single outlet header.

The FIG. 8 depicts yet another arrangement of the vertically aligned stacks in the once-through evaporator. In the FIG. 8, two or more vertically aligned tube stacks are in fluid communication with a single inlet header and a single outlet header. The inlet header 204*ab* and the outlet header 206*ab* are in fluid communication with two tube stacks 210*a* and 210*b*. Similarly, the inlet header 204*ab* and the outlet header 206*ab* are in fluid communication with two tube stacks 210*a* and 210*b*. Tube stacks 210*c* and 210*d* are in fluid communication with inlet header 204*cd* and outlet header 206*cd*. The inlet headers 204*ab* and 204*cd* are in fluid communication with the inlet manifold 202, while the outlet headers 206*ab* and 206*cd* are in fluid communication with the outlet manifold 208 respectively. From the FIG. 8, it may be seen that a plurality of vertically aligned tube stacks may be in fluid communication with a single inlet header and with a single outlet header respectively, or alternatively, a single tube stack may be in fluid communication with a plurality of inlet headers and outlet headers.

Figure 9:
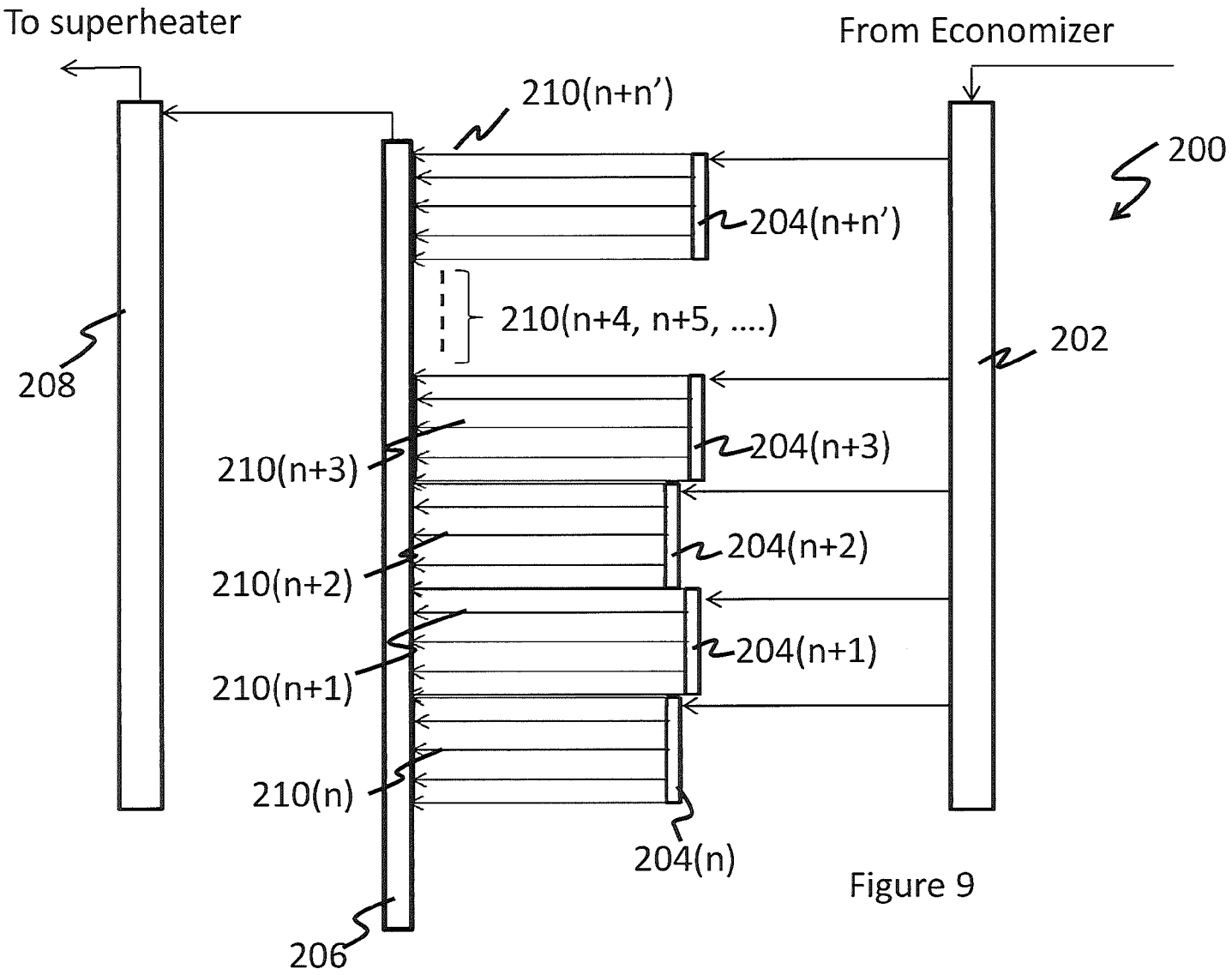
FIG. 9 shows separate zones (vertically aligned tube stacks) that are in fluid communication with a plurality of inlet headers.
Figure 10:
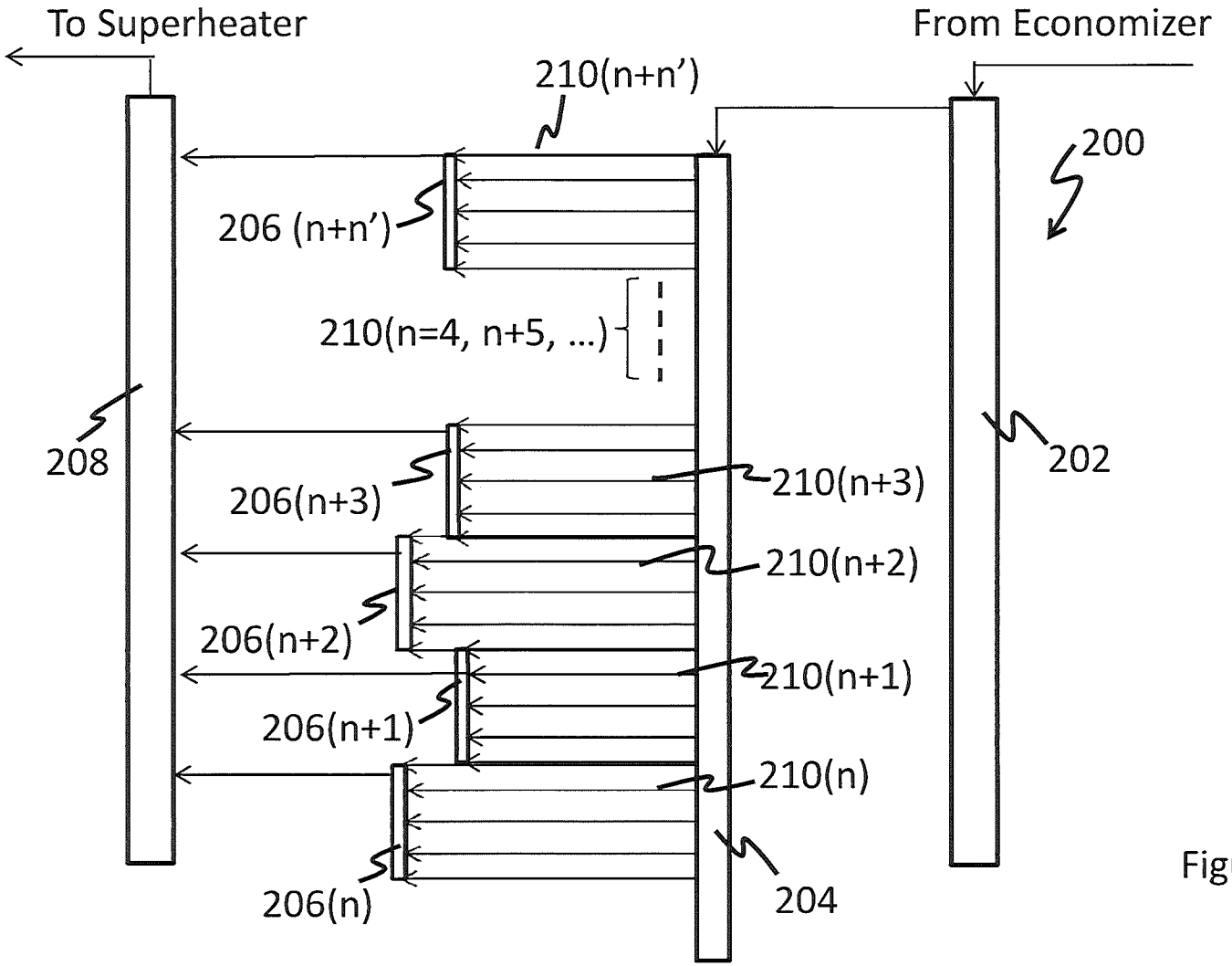
FIG. 10 shows separate zones (vertically aligned tube stacks) that are in fluid communication with a plurality of outlet headers.
Figure 11:
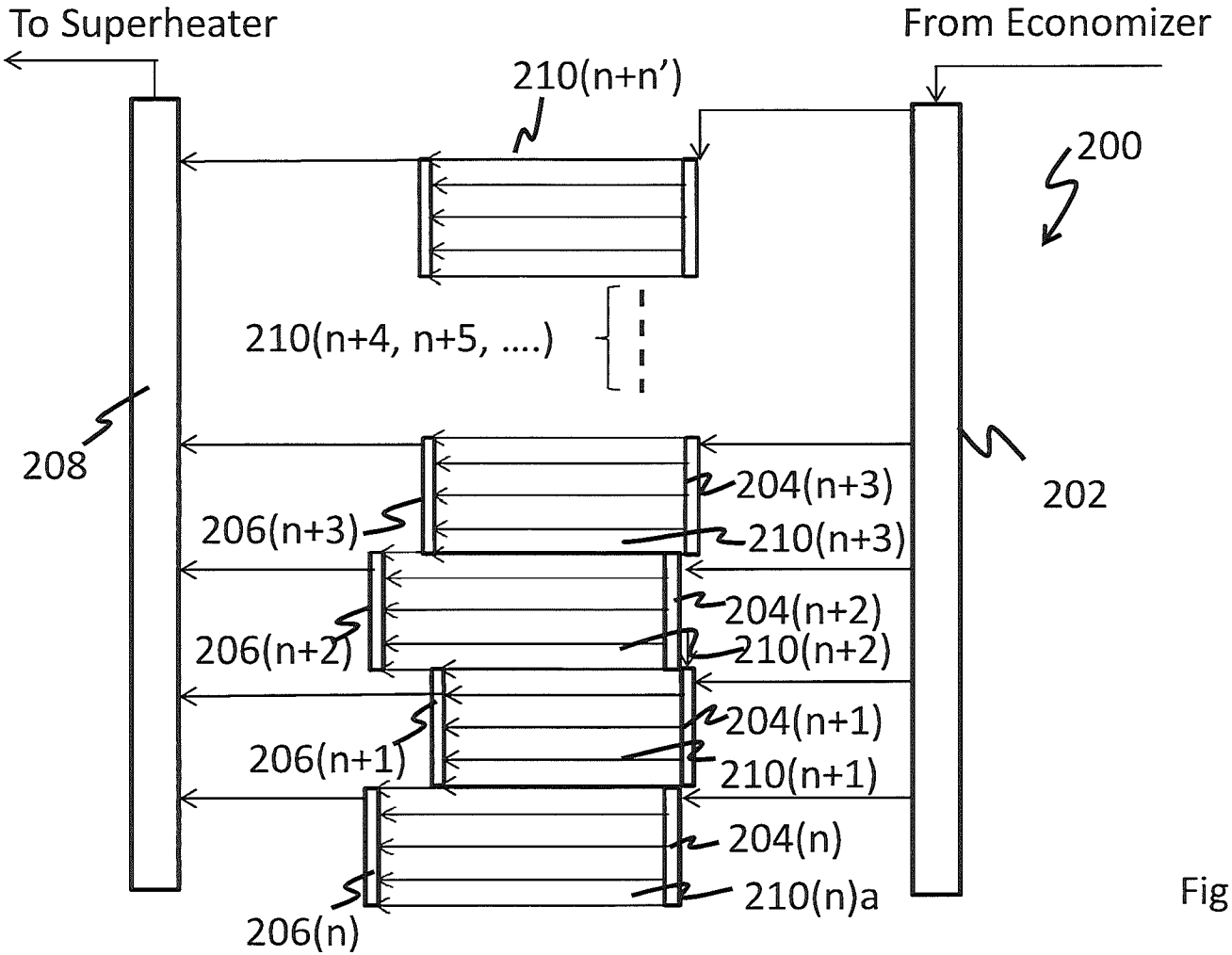
FIG. 11 shows separate zones (vertically aligned tube stacks) that are in fluid communication with a plurality of inlet headers and a plurality of outlet headers.

In one embodiment, the once-through evaporator can have a single evaporator section comprising a plurality of tube stacks 210(*n*) that are not separated from each other as shown in FIGS. 9-11. The evaporator section in the FIGS. 9-11 has multiple vertically aligned tube stacks 210(*n*), 210(*n*+1), and so on, that are arranged to have no passage between them. The hot air that impinges on the once-through evaporator section does not by-pass any heating surfaces, thus improving heat transfer efficiency of the evaporator. The separate zones may be in fluid communication with a plurality of inlet headers 204(*n*) (See FIG. 9.), a plurality of outlet headers 206(*n*) (See FIG. 10.) or a plurality of inlet headers 204(*n*) and outlet headers 206(*n*) (See FIG. 11.). From the FIGS. 9-11, it can be seen that the once-through evaporator comprises a single stack of tubes where the stack is separated into separate sections or zones associated with individual inlet and/or outlet headers. Each of a plurality of inlet headers and/or a plurality of outlet headers may be associated with a particular section of evaporator tubes. The present invention also contemplates that the sections of the FIGS. 2 through 8 may be separated into zones as described in FIGS. 9-11. In other words, a once-through evaporator may have some tube stacks that may be separated by a passage 239 as depicted in the FIG. 2, while other tube stacks have no such passage between them as depicted in the FIGS. 9-11.

While each section is shown to have a similar number of evaporator tubes or have similar dimensions and other characteristics, the present invention contemplates that differences may exist between different sections and or zones of the once-through evaporator. Different tube stacks, sections or zones may be customized for control of operations or for other functions. Such functions include flow rates, tube parameters, flow rate, dimensions of each section or zone, spacing of tubes, inclination of the tubes, or the like, or combinations thereof.

Figure 12:
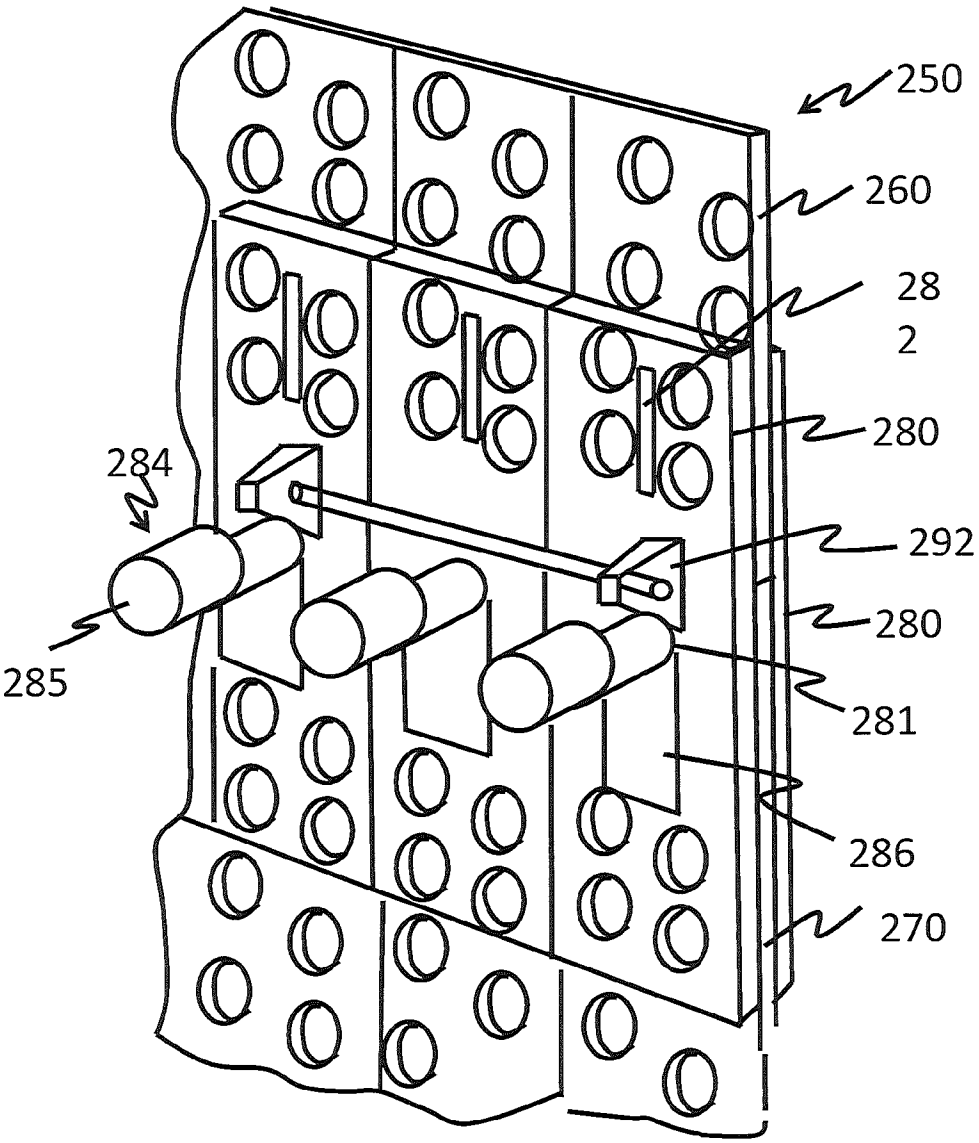
FIG. 12 depicts a section of a plate 250 that is used to support the tube stacks.

As detailed above in the FIGS. 3, 4(A), and 5, the vertically aligned tube stacks 210(*n*) are supported by plates 250. A plurality of plates is disposed between the inlet and outlet headers to support the tubes. In one embodiment, at least one pair of plates are disposed between the inlet header 204(*n*) and the outlet header 206(*n*). The FIG. 12 depicts an embodiment of an exemplary plate 250 that is used to support the tube stacks. Each plate 250 may be manufactured from a metal, a ceramic or other high temperature materials that can withstand the temperature of the furnace.

Since a large number of tube stacks are to be vertically aligned, each plate 250 may comprise a plurality of plates 260, 270, and so on, that are vertically aligned by means of a pair of clevis plates 280 to produce a stable plate 250 that can support a plurality of tube stacks 210(*n*).

As depicted in the FIG. 12, the plurality of plates 260, 270, and so on, which form the plate 250 will be supported by the "clevis" plates 280 on the lower side of the plate 260 to accept the upper portion of the plate 270. The clevis plates 280 are disposed on either side of the plates 260 and 270 to provide support to them. Each plate 250 thus has two clevis plates—a top clevis plate that holds it against gravity and a bottom clevis plate that provides an anchor for holding a succeeding plate. The plate 270 accommodates the lower tube stack (not shown), while the plate 260 accommodates the upper tube stack (not shown). The tube stacks are thus vertically aligned by the plates 260 and 270, while the clevis plate 280 holds the two plates 260 and 270 in the desired vertical alignment with each other.

The lower end of each of the plurality of plates 260, 270, and so on, on both the inner and outer surface of the plates include a clevis plate 280 fixedly attached thereto. In one embodiment, the clevis plate 280 may be welded to the plurality of plates 260, 270, and the like. In another embodiment, the clevis plate 280 may be bolted or screwed to the plurality of plates 260, 270, and the like.

As can be seen in the FIG. 12, each plate 260, 270, has a plurality of holes 272 for accommodating the tubes of the tube stacks. The upper portion of each clevis plate 280 includes a vertical slot 282 to permit a bead weld to affix the clevis plate 280 to the upper plate 260. The lower portion of the pair of clevis plates 280 (one clevis plate 280 is disposed on each side of the plates 260 and 270) extends below the lower portion of plate 260 to receive therebetween the upper portion of the lower plate 270. The lower plate 270 aligns the lower evaporator tube stack with the upper evaporator tube stack that is held in position by the upper plate 260. The upper plate 260 and lower plate 270 will then be connected via the clevis plates 280 using field installed connecting pins 284.

The lower portion of each clevis plate 280 and upper portion of the plate 270 each have a hole 281 for receiving connecting pins 284 through the aligned holes 281. Each pin includes a head 285 at one end for engaging one side of the clevis plate 280 and a notch or groove 286 in the other end. The machined connecting pins 284 will be positioned during erection via a carriage fixture (not shown). The connecting pins 284 are then driven through the holes 281. When the modules/sections are lifted and hung from supports (not shown) a shop welded locking plate disposed on the clevis plate 280 to engage the groove or notch to prevent the connecting pins from backing out of the holes 281. Therefore, as the lower plate 270 and pins 284 pull downward, the locking plates engage the groove or notch of the pins.

To prevent the plates 260, 270, from spreading horizontally and twisting causing large gaps between the plates 260, 270, in the gas flow direction, a reinforcing tie bar 290 is used. These tie bars 290 are secured to the clevis plates 280. The tie bars 290 reinforce the clevis plates and prevent the clevis plates 280 from warping. One or more intermediate collar or supports 292 may be provide to prevent the tie bars from sagging. A tie bar may be disposed on each of the clevis plates 280 on both sides of the plates 260, 270.

Figure 13:
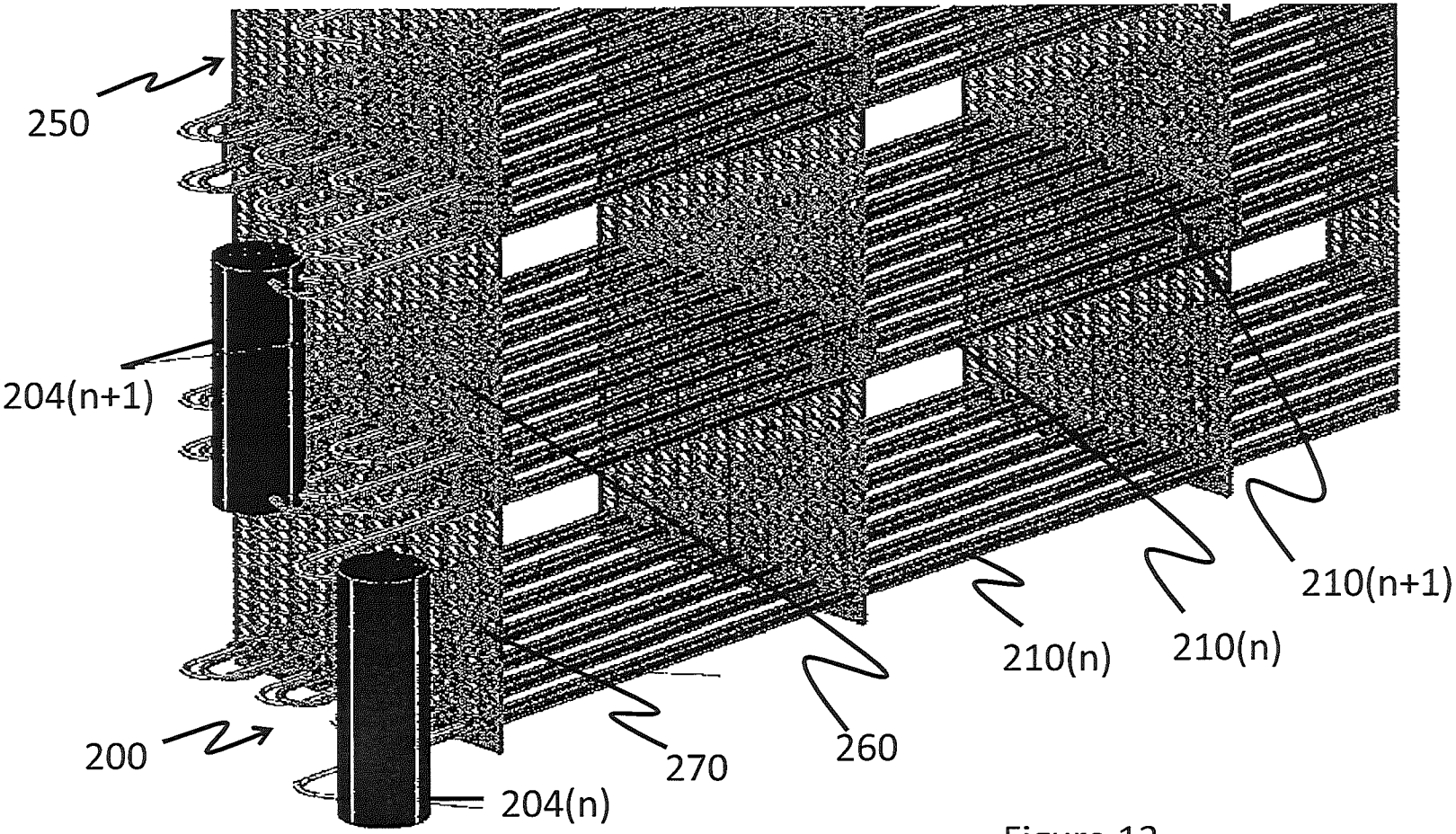
FIG. 13 shows a portion of vertically stacked tubes that form a once-through evaporator.

FIG. 13 depicts how the clevis plate 280 contacts the plates 250 (i.e., the plurality of plates 260, 270, and so on), which support the tubes of the tube stacks to create an assembled once-through evaporator 200. The individual tubes of the tube stacks are supported by the plates 260, 270. For example, the tubes of tube stack 210(*n*) are supported by plate 270, while the tubes of tube stack 210(*n*+1) are supported by the plate 260. It is to be noted that the tube stack 210(*n*) in the FIG. 13 is represented by only the uppermost tube and the lowermost tube. The entire tube stacks 210(*n*) and 210(*n*+1) are not shown in order to clearly depict the other portions of the once-through evaporator. As can be seen in the FIG. 13, the tubes are threaded through the holes in the plate 250. The ends of the tubes are bent around to give the tubes their serpentine shape. Each tube stack 210(*n*) is in fluid communication with respective inlet headers 204(*n*). Each fluid stack 210(*n*) is also in fluid communication with respective outlet headers 206(*n*).

In one embodiment, in one method of manufacturing the once-through evaporator, the respective plates are first aligned and fixed to each other using the clevis plates. The connecting pins are placed through the plates and the clevis plates. The weight of the plates secures their locations between the clevis plates. Butt welds are then disposed in the vertical slots to further secure the plates between the clevis plates. The individual tubes (having threads) are then located in the holes in the plates. The horizontal and vertical bends are then put into position and the tubes are screwed into the bends to form the tube stacks. In one embodiment, each tube has already affixed to it one bend, and two tubes each having their own respective bends are then screwed into each other (with the plates supporting them) to form the tube stack. After all of the tubes are screwed together to form the vertical aligned tube stack, the tube stack is then fixedly or detachably attached to the inlet and outlet headers as per the selected design (see FIGS. 2-11 for the different designs). In one embodiment, the respective tubes from each tube stack may be welded onto the respective inlet and outlet headers. The inlet and outlet headers are then fixedly or detachably attached to the inlet and outlet manifolds. The sections may be assembled partially (into modules) or completely assembled at a plant and shipped to sites at which they will be deployed. Alternatively, portions of various sections (modules) may be assembled at a plant site and can then be shipped to the deployment site for further assembly.

Figure 14:
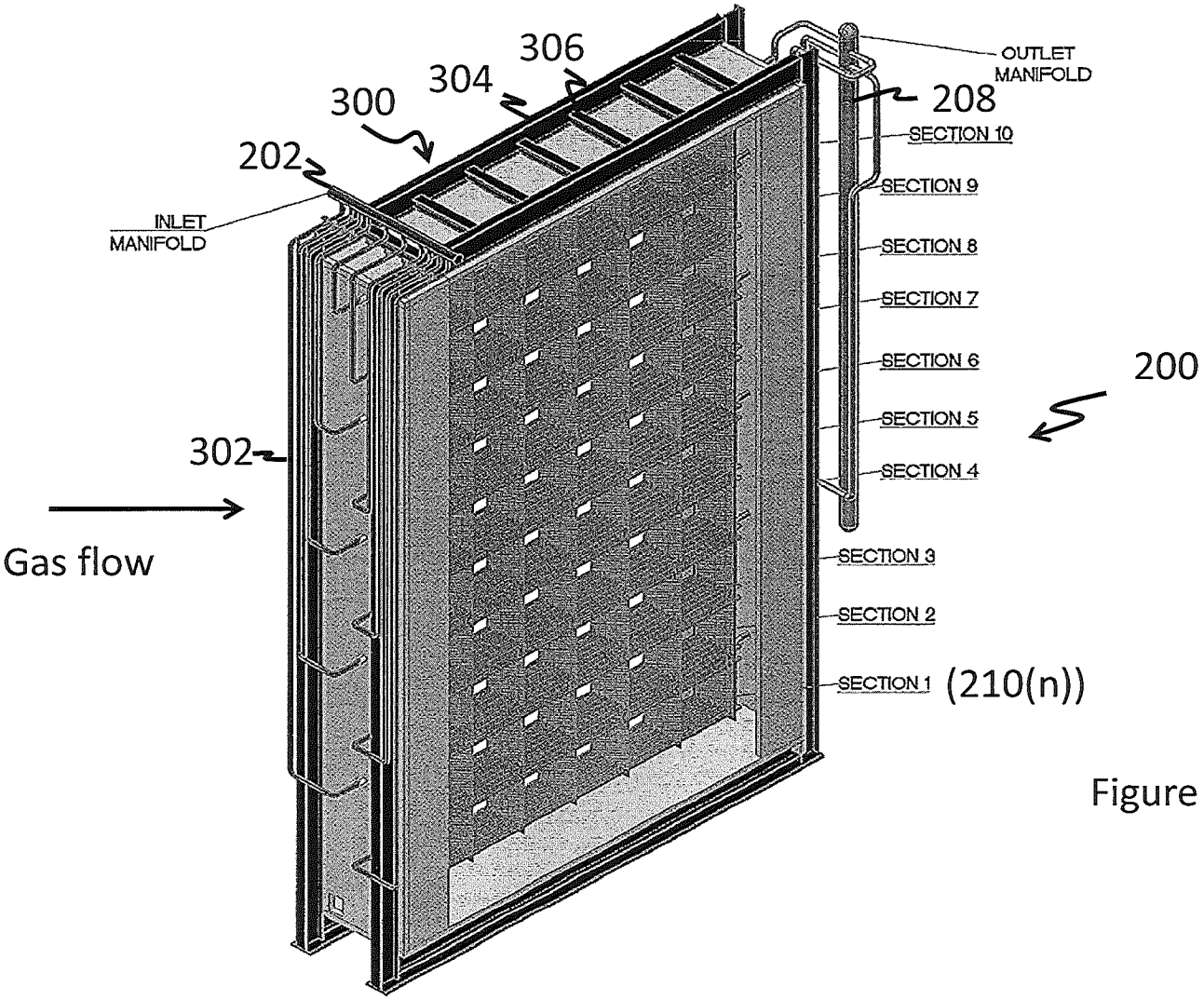
FIG. 14 depicts a once-through evaporator having 10 vertically aligned zones or sections that contain tubes through which hot gases can pass to transfer their heat to the working fluid.

The FIG. 14 depicts another assembled once-through evaporator. The FIG. 14 shows a once-through evaporator having 10 vertically aligned tube stacks 210(*n*) that contain tubes through which hot gases can pass to transfer their heat to the working fluid. The tube stacks are mounted in a frame 300 that comprises two parallel vertical support bars 302 and two horizontal support bars 304. The support bars 302 and 304 are fixedly attached or detachably attached to each other by welds, bolts, rivets, screw threads and nuts, or the like.

Disposed on an upper surface of the once-through evaporator are rods 306 that contact the plates 250. Each rod 306 supports the plate and the plates hang (i.e., they are suspended) from the rod 306. The plates 250 (as detailed above) are locked in position using clevis plates. The plates 250 also support and hold in position the respective tube stacks 210(*n*). In this FIG. 14, only the uppermost tube and the lowermost tube of each tube tack 210(*n*) is shown as part of the tube stack. The other tubes in each tube stack are omitted for the convenience of the reader and for clarity's sake.

Since each rod 306 holds or supports a plate 250, the number of rods 306 are therefore equal to the number of the plates 250. In one embodiment, the entire once-through evaporator is supported and held-up by the rods 306 that contact the horizontal rods 304. In one embodiment, the rods 306 can be tie-rods that contact each of the parallel horizontal rods 304 and support the entire weight of the tube stacks. The weight of the once-through evaporator is therefore supported by the rods 306.

Each section is mounted onto the respective plates and the respective plates are then held together by tie rods 300 at the periphery of the entire tube stack. A number of vertical plates support these horizontal heat exchangers. These plates are designed as the structural support for the module and provide support to the tubes to limit deflection. The horizontal heat exchangers are shop assembled into modules and shipped to site. The plates of the horizontal heat exchangers are connected to each other in the field.

Figures 15A, 15B:
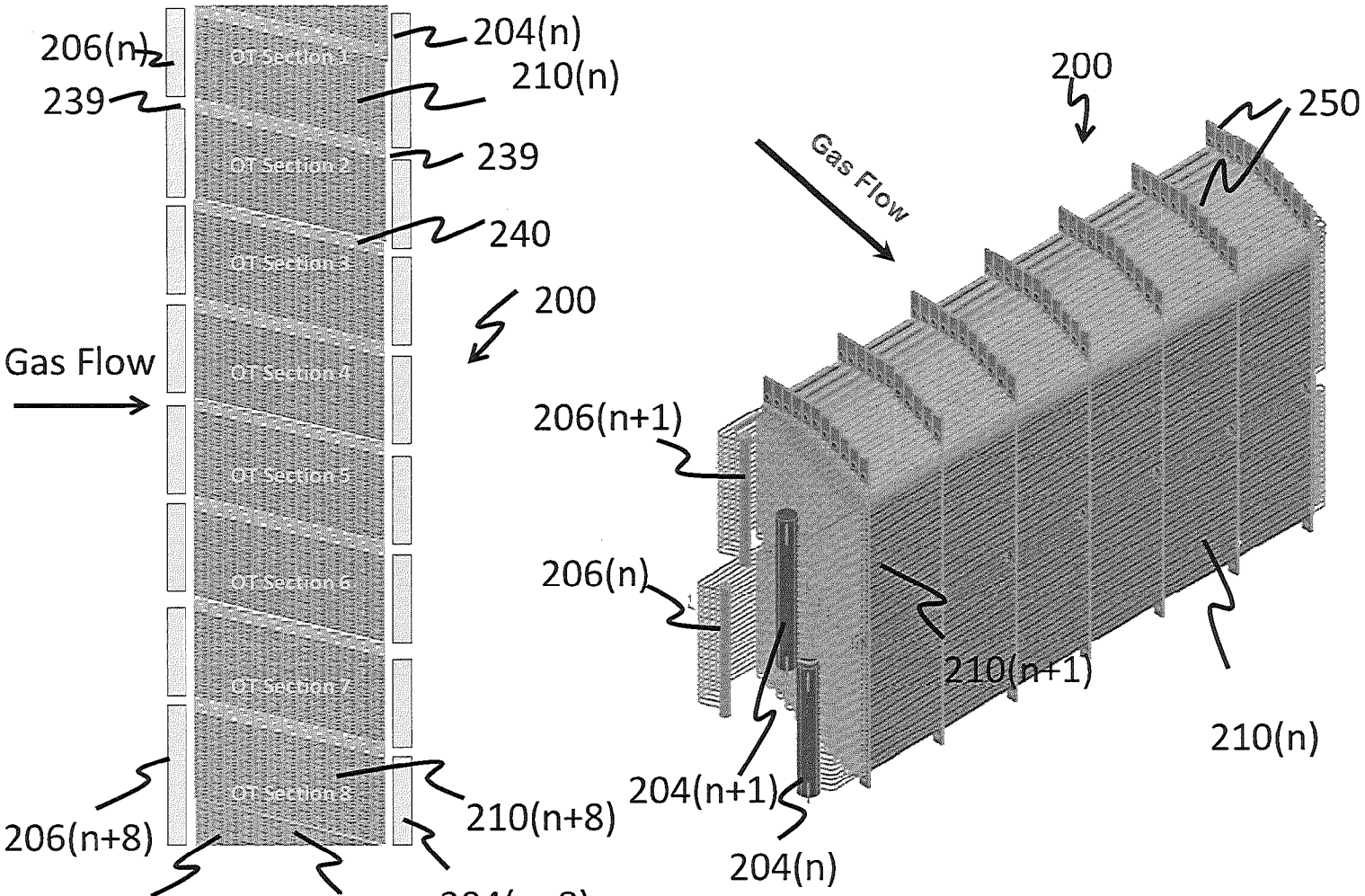
FIG. 15(A) depicts one exemplary arrangement of the tubes in a tube stack of a once-through evaporator.
FIG. 15(B) depicts an isometric view of an exemplary arrangement of the tubes in a tube stack of a once-through evaporator.

FIG. 15(A) depicts one exemplary arrangement of the tubes in a tube stack of a once-through evaporator 200 and the FIG. 15(B) depicts an isometric view of an exemplary arrangement of the tubes in a tube stack of a once-through evaporator 200. As can be seen in the FIG. 15(A), there are 8 tube stacks vertically aligned, with a fractional stack disposed at both ends 270. A passage 239 lies between adjacent stacks into which a baffle system 240 may be disposed if desired. The baffle system 240 deflects the incoming hot gases into the tube stacks to heat the working fluid. The FIG. 15(B) is an isometric view of a once-through evaporator showing two tube stacks in fluid communication with the corresponding inlet and outlet headers. The tube stacks 210(*n*) are supported by a plurality of plates 250, which have holes through which individual tubes pass.

It is to be noted that this application is being co-filed with Patent Applications, the entire contents of which are all incorporated by reference herein.

Maximum Continuous Load" denotes the rated full load conditions of the power plant.

"Once-through evaporator section" of the boiler used to convert water to steam at various percentages of maximum continuous load (MCR).

"Approximately Horizontal Tube" is a tube horizontally orientated in nature. An "Inclined Tube" is a tube in neither a horizontal position or in a vertical position, but dispose at an angle therebetween relative to the inlet header and the outlet header as shown.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, singular forms like "a," or "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

The term and/or is used herein to mean both "and" as well as "or". For example, "A and/or B" is construed to mean A, B or A and B.

The transition term "comprising" is inclusive of the transition terms "consisting essentially of" and "consisting of" and can be interchanged for "comprising".

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A once-through evaporator for transferring heat between a heated fluid flow and a working fluid; the once-through evaporator comprising:

an inlet manifold to receive the working fluid;

one or more inlet headers in fluid communication with the inlet manifold;

a plurality of tube stacks, each tube stack comprising a plurality of evaporator tubes, each of the evaporator tubes being disposed in a single plane and defining a serpentine shape, each of the evaporator tubes defining multiple bends wherein each of the evaporator tubes turn through an angle of approximately 180 degrees at each end of a plurality of straight runs, a direction of each successive bend in each of the evaporator tubes is opposed to the direction of the preceding bend, each of the evaporator tubes being spaced apart from an adjacent one of the evaporator tubes in the tube stack, each of the evaporator tubes defining an inlet and an outlet;

an inlet of each of the evaporator tubes being in fluid communication with the inlet header;

one or more outlet headers in fluid communication with the outlet of each of the evaporator tubes;

an outlet manifold in fluid communication with the one or more outlet headers;

the tube stacks being positionable so that the straight runs of each of the evaporator tubes are arranged perpendicular to a direction of the heated fluid flow;

each of the tube stacks including a plate to support the plurality of evaporator tubes of the tube stack;

a plurality of clevis plate for attaching the plates of adjacent tube stacks; and a tie bar secured to the clevis plates of adjacent tube stacks for preventing the clevis plates from spreading or warping.

2. The once-through evaporator of claim 1, wherein the one or more inlet header includes an inlet header in fluid communication with a plurality of tube stacks.

3. The once-through evaporator of claim 1, wherein the one or more inlet headers includes a plurality of inlet headers, each inlet header being in fluid communication with a respective tube stack.

4. The once-through evaporator of claim 1, wherein the one or more outlet headers includes an outlet header in fluid communication with the plurality of tube stacks.

5. The once-through evaporator of claim 1, wherein the one or more inlet headers is horizontal.

6. The once-through evaporator of claim 1, wherein the one or more inlet headers is vertical.

7. The once-through evaporator of claim 1, wherein each tube stack directly contacts an adjacent tube stack so that there is no passage between adjacent tube stacks.

8. The once-through evaporator of claim 1, where the clevis plate has an upper portion for engaging a lower portion of one plate and a lower portion for engaging an upper portion of another plate.

9. The once-through evaporator of claim 1, further comprising a connecting pin disposed through the clevis plate and a plate to connect adjacent plates, wherein a lower tube stack is suspended from an upper tube stack by the clevis plate and connecting pin.

10. The once-through evaporator of claim 1, wherein the one or more outlet headers includes a plurality of outlet headers, each outlet header being in fluid communication with a respective tube stack.

11. The once-through evaporator of claim 3, wherein the one or more outlet headers includes a plurality of outlet headers, each outlet header being in fluid communication with a respective tube stack.

12. The once-through evaporator of claim 3, wherein the one or more outlet headers includes an outlet header in fluid communication with the plurality of tube stacks.

13. The once-through evaporator of claim 2, wherein the one or more outlet headers includes a plurality of outlet headers, each outlet header being in fluid communication with a respective tube stack.

14. The once-through evaporator of claim 2, wherein the one or more outlet headers includes an outlet header in fluid communication with the plurality of tube stacks.

15. The once-through evaporator of claim 10, wherein the plurality of outlet headers are not vertically aligned.

16. The once-through evaporator of claim 11, wherein the plurality of outlet headers are not vertically aligned.

17. The once-through evaporator of claim 13, wherein the plurality of outlet headers are not vertically aligned.

18. The once-through evaporator of claim 3, wherein the plurality of inlet headers are not vertically aligned.

19. The once-through evaporator of claim 11, wherein the plurality of inlet headers are not vertically aligned.

20. The once-through evaporator of claim 12, wherein the plurality of inlet headers are not vertically aligned.

* * * * *